US006194133B1

(12) United States Patent
Sato

(10) Patent No.: US 6,194,133 B1
(45) Date of Patent: Feb. 27, 2001

(54) SILVER HALIDE PHOTOGRAPHIC MATERIAL

(75) Inventor: Tadanobu Sato, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/310,094

(22) Filed: May 12, 1999

(30) Foreign Application Priority Data

| | | |
|---|---|---|
| May 12, 1998 | (JP) | 10-129336 |
| Jun. 5, 1998 | (JP) | 10-157800 |
| Jun. 18, 1998 | (JP) | 10-171667 |
| Oct. 5, 1998 | (JP) | 10-282813 |

(51) Int. Cl.[7] ..... G03C 1/08; G03C 1/005

(52) U.S. Cl. ..... 430/567; 430/569; 430/599; 430/600

(58) Field of Search ..... 430/567, 569, 430/599, 600

(56) References Cited

U.S. PATENT DOCUMENTS 5,360,712 11/1994 Olm et al. ..... 430/567

FOREIGN PATENT DOCUMENTS 10-293377 11/1998 (JP) .

*Primary Examiner*—Janet Baxter
*Assistant Examiner*—Amanda C. Walke
(74) *Attorney, Agent, or Firm*—Sughrue, Mion, Zinn, Macpeak & Seas, PLLC

(57) ABSTRACT

A silver halide photographic material comprising a support having thereon at least one silver halide emulsion layer, wherein said emulsion contains as a dopant a metal complex represented by the following formula (I) or (II):

$$[ML_xL^I_{(4-x)}]^n \quad \text{(I)}$$

wherein M represents a metal or a metal ion, L represents an imidazole compound which is bonded to M, x represents 1, 2, 3 or 4, n represents an integer of from −6 to +5, and $L^I$ represents a chemical species bonded to M and $L^I_{(4-x)}$ may be the same or different chemical species when x is 1 or 2;

$$[MX_nL_{(6-n)}]^m \quad \text{(II)}$$

wherein M represents a metal ion, L represents an imidazole compound, X represents a halogen ion, n represents 3, 4 or 5, and m represents −5, −4, −3, −2, −1, 0, +1 or +2.

10 Claims, No Drawings

SILVER HALIDE PHOTOGRAPHIC MATERIAL

FIELD OF THE INVENTION

The present invention relates to a silver halide photographic material and, particularly, to a high-speed silver halide photographic material that comprises a complex having an imidazole compound (or derivative) as a ligand.

BACKGROUND OF THE INVENTION

As one of the techniques of modifying silver halide grains so that the properties of a silver halide photographic material as a whole show as much improvements as are expected, there is well-known the technique of incorporating a substance other than silver and halide ions into silver halide grains. This art is referred to as "doping technique", the substance incorporated into silver halide grains is referred to as "dopant", and to incorporate a dopant into silver halide grains is referred to as "to dope". In particular, many researches on the techniques of doping transition metal ions have been made. As a result, it is generally recognized that the photographic properties can be modified effectively by transition metal ions got into silver halide grains as a dopant even if the ions are added in a very slight amount.

For heightening the sensitivity of silver halide emulsions, there is known the technique of doping silver halide grains with the metal complexes of the group VIII in the periodic table having cyanide ions as ligands. As dopants having cyanide ions, for instance, JP-B-48-35373 (the term "JP-B" as used herein means an "examined Japanese patent publication") discloses hexacyanoferrate complexes, such as potassium ferrocyanide and potassium ferricyanide. However, the effect of that invention is produced in only the cases using the iron ion-containing dopants, irrespective of the species of ligands. JP-B-49-14265 discloses, as a silver halide emulsion having high sensitivity under high illumination intensity, the emulsion comprising silver halide grains which are 0.9 $\mu$m or below in grain size, are subjected to the addition of the metal compound in a group VIII in the periodic table in an amount of $10^{-6}$ to $10^{-3}$ mole per mole of silver ions during the formation thereof and is subjected to spectral sensitization with a merocyanine dye. According to this technique, high-speed emulsions can be obtained. In JP-A-5-66511 (the term "JP-A" as used herein means an "unexamined published Japanese patent application") and U.S. Pat. No. 5,132,203, it is demonstrated that high-speed materials are obtained by doping the sub-surface layer of silver halide grains with hexacyanoferrate(II). Further, JP-A-2-20853 discloses that silver iodochloride doped with rhenium, ruthenium, osmium and iridium complexes having cyanide ions as ligands can provide high sensitivity on silver halide emulsions. On the other hand, JP-A-121844 discloses the high-speed emulsion comprising light-sensitive silver halide grains each which is constituted of two or more parts different in halide composition and contains divalent iron ions in an amount of at least $10^{-7}$ mole/mole-Ag in the part having the halide composition lowest in band gap energy.

In order to make high-speed emulsions by means of the doping technique, the metal complex of the group VIII in the periodic table, such as hexacyanoiron(II) complexes and hexacyanoruthenium(II) complexes, are frequently employed as dopants. Many of other metal complexes are also used as dopants, and can produce not only the sensitivity increasing effect but also a wide variety of effects including improvement of reciprocity failure and increasing contrast. In U.S. Pat. No. 2,448,060, it is disclosed that the doping with platinum or palladium(III) complexes having halogen ions as ligands can sensitize emulsions. The silver halide emulsions containing cyano complexes of iron(II), iron(III) or cobalt(III) and spectral sensitizing dyes are disclosed in U.S. Pat. No. 3,790,390. The silver halide grains formed in the presence of a rhodium(III) complex having 3, 4, 5 or 6 cyano ligands are disclosed in U.S. Pat. No. 4,847,191. Those patents prove that the dopants can diminish high intensity failure. The silver halide emulsions doped with rhenium, ruthenium, osmium or iridium complexes having at least 4 cyano ligands are disclosed in European Patent 0,336,425, European Patent 0,335,426, JP-A-2-20853 and JP-A-2-20834. It is described therein that the doped silver halide emulsions are improved in storage stability of sensitivity and gradation, and reduced in low intensity failure. European Patent 0,336,427 and JP-A-2-20852 disclose the silver halide emulsions using vanadium, chromium, manganese, iron, ruthenium, osmium, rhenium and iridium complexes having the coordination number of six and containing nitrosyl or thionitrosyl ligands and thereby showing improvement in low intensity reciprocity failure without attended by lowering of medium illumination sensitivity. As the dopants other than transition metal ions, the emulsions doped with bismuth or lead ions are disclosed in U.S. Pat. No. 3,690,888, and the emulsions containing the metal ions of the group XIII or XIV in the periodic table are disclosed in JP-A-7-128778.

The metal complex dope given to silver halide grains, as mentioned above, causes various changes in photographic properties. Most of metal complexes so far used for doping silver halide grains are six-coordinate complexes (i.e., six-coordinated complexes) having an octahedron structure (i.e., an octahedral structure). This is because the six-coordinate complexes having an octahedron structure have been regarded as good dopants for a reason that, as described in *J. Phys.:* Condens. Matter 9 (1997) 3227–2240, when a six-coordinate metal complex having the octahedron structure, such as hexacyanoferrate(II), is added for doping silver halide grains, the complex ion $[AgX_6]^{-5}$ (X=halogen ion) functions as a unit in silver halide grains to enable partial replacement of the grains by the dopants having the same structure as the aforesaid unit. With respect to the cases where silver halide grains are doped with complexes having coordination structures other than a six-coordinate octahedron structure, $[PtCl_4]^{2-}$ and $[PdCl_4]^{2-}$ are used for the doping in U.S. Pat. No. 2,448,060, $[Pt(CN)_4]^{-2}$, $[Pd(CN)_4]^{-2}$ and $[Ni(CN)_4]^{-2}$ in JP-A-5-346633, $[CoCl_4]^{-2}$ and $[Co(CN)_4]^{-2}$ in JP-A-5-134344, and $[Zn(CNO)_4]^{-2}$ in JP-A-4-305644. However, these four-coordinate complexes (i.e., four-coordinated complexes) are each used merely as a member of related compounds for a series of doping tests wherein six-coordinate complexes having an octahedron structure are used as dopants, and a clear concept of doping silver halide with four-coordinate complexes cannot be found in those patents. In other words, it is supposed that those four-coordinate complexes are employed from the viewpoint of changing the species of metal ion or ligand. There are unknown the cases of using four-coordinate complexes other than the above-recited ones for doping silver halide grains.

With respect to the ligands of complexes used for the doping, not only cyanide ion but also ions of diverse chemical species are utilized. Besides cyanide ion, halogen ions are frequently used as ligands. For instance, hexachlororuthenate, hexachloroiridate, hexachlororhodate and hexachlororhenate are disclosed as doping complexes having a $[MCl_6]^{n-}$ structure, wherein M is an arbitrary metal, in JP-A-63-184740, JP-A-1-285941, JP-A-2-20852 and JP-A-2-20855. Further, European Patent 0,336,689 and JP-A-2-20855 disclose, as dopants, the six-coordinate rhenium complexes whose ligands are halogeno, nitrosyl, thionitrosyl, cyano, aquo and thiocyano. Furthermore, as emulsions having useful photographic properties, the emulsion wherein is incorporated the six-coordinate transition metal complex having carbonyl as one of the ligands and the emulsion wherein is incorporated the six-coordinate transition metal complex having oxo as two of the ligands are disclosed in JP-A-3-118535 and JP-A-3-118536 respectively. In addition, the cases wherein the complexes having heterocyclic compounds as ligands are used as dopants are disclosed in U.S. Pat. No. 5,360,712.

However, the known cases wherein the complexes having an arbitrary imidazole compound (L') as a ligand are used as dopants are only the cases disclosed in U.S. Pat. No. 5,360,712 cited above wherein $[Fe(CN)_5(L')]^{3-}$ and $[Ru(CN)_5(L')]^{3-}$ are used respectively. While the complexes having six cyano ligands and the above-recited complexes wherein cyanide ions are present as ligands can provide high sensitivity upon emulsions, they inhibit the formation of sensitized nuclei by gold sensitizers, as disclosed in JP-A-8-62761. Therefore, using cyanide ion-free complexes is desired for efficiently making high-speed emulsions. The absence of cyanide ions in complexes is desirable from the viewpoint of the toxicity of cyanide ions, too. No cases are known wherein complexes having no cyanide ions but imidazole compounds as ligands are used as dopants, whether they are four-coordinate or six-coordinate.

SUMMARY OF THE INVENTION

An object of the present invention is therefore to built up the doping technique covering a wider scope than ever, and thereby to provide a silver halide photographic material having higher sensitivity than ever without using cyanide ions.

The aforesaid object is attained with silver halide photographic materials according to the following embodiments (1) to (10) respectively:

(1) A silver halide photographic material comprising a support having thereon at least one silver halide emulsion layer, wherein said emulsion contains a compound represented by the following formula (I) or (II):

$$[ML_xL^I_{(4-x)}]^n \quad (I)$$

wherein M represents a metal or a metal ion; L represents a compound of the following formula (III) which is bonded to M; x represents 1, 2, 3 or 4; n represents an integer of from −6 to +5; and $L^I$ represents a chemical species bonded to M, and $L^I_{(4-x)}$ may be the same or different chemical species when x is 1 or 2;

(III)

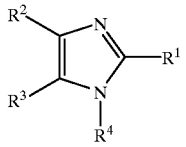

wherein $R_1$, $R_2$, $R_3$ and $R_4$ each represent a hydrogen atom, an alkyl group, an alkenyl group, an alkinyl group, an aralkyl group, a cycloalkyl group, an aryl group, a halogen atom, a cyano group, a nitro group, a mercapto group, a hydroxy group, an alkoxy group, an aryloxy group, an alkylthio group, an arylthio group, an acyloxy group, a sulfonyloxy group, an amino group, an ammonio group, a carbonamido group, a sulfonamido group, an oxycarbonylamino group, an oxysulfonylamino group, an ureido group, a thioureido group, an acyl group, an oxycarbonyl group, a carbamoyl group, a thiocarbonyl group, a thiocarbamoyl group, a sulfonyl group, a sulfinyl group, an oxysulfonyl group, a sulfamoyl group, a sulfino group, a sulfano group, a carboxyl or carboxylate group, a sulfonic acid or sulfonate group, or a phosphonic acid or phosphonate group, and $R_2$ and $R_3$ may be subjected to ring closure each other to form a saturated carbon ring, an aromatic hydrocarbon ring or a heterocyclic aromatic ring;

$$[MX_nL_{(6-n)}]^m \quad (II)$$

wherein M represents a metal ion, L represents a compound of the foregoing formula (III), X represents a halogen ion, n represents 3, 4 or 5, and m represents −5, −4, −3, −2, −1, 0, +1 or +2.

Preferred embodiments are described below.

(2) The silver halide photographic material according to the embodiment (1), wherein the silver halide emulsion comprises silver halide agains containing the compound represented by formula (I) or (II).

(3) The silver halide photographic material according to the embodiment (1) or (2), wherein the M in formula (I) is at least one metal or metal ion selected from the group consisting of titanium, vanadium, chromium, manganese, iron, cobalt, nickel, copper, zirconium, rhodium, palladium, silver, iridium, platinum, gold, tin and the ions thereof.

(4) The silver halide photographic material according to the embodiment (1) or (2), wherein at least one of the chemical species represented by $L^I$ when x is 1, 2 or 3 in formula (I) is a halogen ion.

(5) The silver halide photographic material according to the embodiment (4), wherein the M in formula (I) is at least one metal ion selected from the group consisting of cobalt, nickel and copper ions.

(6) The silver halide photographic material according to the embodiment (5), wherein at least one of the groups $R_1$, $R_2$ and $R_3$ in formula (III) is a group selected from the group consisting of a methyl group, an ethyl group, a n-propyl group and an i-propyl group.

(7) The silver halide photographic material according to the embodiment (6), wherein the chemical species represented by $L^I$ in formula (I) is a chlorine ion.

(8) The silver halide photographic material according to the embodiment (1) or (2), wherein said M in formula (II) is a metal ion selected from the group consisting of ruthenium, titanium, manganese, platinum and tin ions.

(9) The silver halide photographic material according to the embodiment (8), wherein at least one of the groups $R_1$, $R_2$ and $R_3$ in the compound of formula (III) is a group selected from the group consisting of a methyl group, an ethyl group, a n-propyl group and an i-propyl group.

(10) The silver halide photographic material according to the embodiment (9), wherein the halogen ion represented by X in formula (II) is a chlorine ion.

DETAILED DESCRIPTION OF THE INVENTION

In the first place, the dopants of formula (I) are described below in detail.

Most of the dopants that have so far been employed are six-coordinate complexes having an octahedron structure. Although four-coordinate complexes were once used as dopants, they are supposed to have been used without the consciousness of coordination structure. The utilization of four-coordinate complexes as the dopants for silver halide grains not only enables a wide selection of dopants but also ensures greater freedom for the design of emulsions having desired photographic characteristics.

Most of four-coordinate complexes have a square planar structure (hereafter, sometimes, referred to as "a planar four-coordination structure") or a tetrahedron structure. Although there are also known complexes having other coordination structures, such as a trigonal pyramid structure, such complexes are very few. The Pt(II) complexes, the Pd(II) complexes, the Ni(II) complexes and $[Co(CN)_4]^{2-}$ hitherto disclosed as the dopants for silver halide grains are complexes having a square planar structure, while $[CoCl_4]^{2-}$ and $[Zn(CNO)_4]^{2-}$ are complexes having a tetrahedron structure. With respect to the complexes having a square planar structure, each metal ion is present at the center of a square, rectangle or rhombus, while the four ligands bonding thereto are situated at the apices of such a quadrangle respectively. Therefore, the metal ion and the four coordinate atoms lie on the same plane (coordination plane) . So long as the complex has such a square planar structure, it is expected to be replaced by $[AgX_4]^{3-}$ present as a unit in silver halide grains to result in the incorporation into silver halide grains, in analogy with the case of doping silver halide grains with a six-coordinate complex having an octahedron structure, wherein the complex is replaced by $[AgX_6]^{3-}$ unit in the silver halide grains to be incorporated thereinto.

On the other hand, units favorable for the replacement by four-coordinate complexes having a tetrahedron structure cannot be found in silver halide grains. For the incorporation of complexes having a tetrahedron structure into silver halide grains, it is therefore necessary that the complexes themselves change their coordination structure so as to be fitted for grain structures. Some of the complexes having a tetrahedron structure are known to change their coordination structure around the metal into a structure comparable to the square planar structure under certain conditions. If such a structural change can be caused in a complex at the time of grain formation, it is expected that the complex can be replaced by $[AgX_4]^{3-}$ unit, thereby enabling the incorporation thereof into silver halide grains.

The energy levels of an aromatic compound can be controlled so as to lie at the intended positions or in those neighborhood by properly changing some of its substituent groups into others. On the other hand, the molecular orbitals of a metal complex are created by interaction between the orbitals of the metal and those of compounds or ions constituting the ligands. Accordingly, it is thought that the energy levels of a complex, particularly those in the vicinity of frontier orbital, can be laid in the intended positions by the use of a heterocyclic aromatic compound having, insides the ring skeleton, a site for coordination with a metal. Further, it is thought that those energy levels can be controlled finely by properly selecting the species of substituent groups of the heterocyclic compound as ligand(s).

It is foreseen in the present invention that, when the ligands of a complex for doping silver halide grains have the same charge as that of halogen ion, or the valence of −1, the complex is apt to dope the silver halide because it can be replaced by $[AgX_4]^{3-}$. Imidazole compounds can be converted into $Im^-$ by elimination of $H^+$ from the NH in each molecule, so that it is expected that the complexes having imidazole compounds as ligands can dope more easily silver halide grains than complexes having other heterocyclic compounds as ligands. The comparisons of the abilities of imidazole, 2-methylimidazole, 2-ethylimidazole and 2-propylimidazole in donating an electron to a metal on the basis of ab initio calculation indicate that their abilities to donate an electron to a metal increase in the order of the above description. Accordingly, it is estimated that the complex can undergo a great influence upon its molecular orbital by change in substituent group(s) of the imidazole and imidazole compounds present as a ligand therein.

Based on the above descriptions, examples of a complex represented by formula (I) according to the present invention are illustrated below, but it should be understood that these examples are not to be construed as limiting the scope of the invention in any way. Additionally, the symbols Me and pro in the following structural formulae stand for methyl and propyl groups respectively.

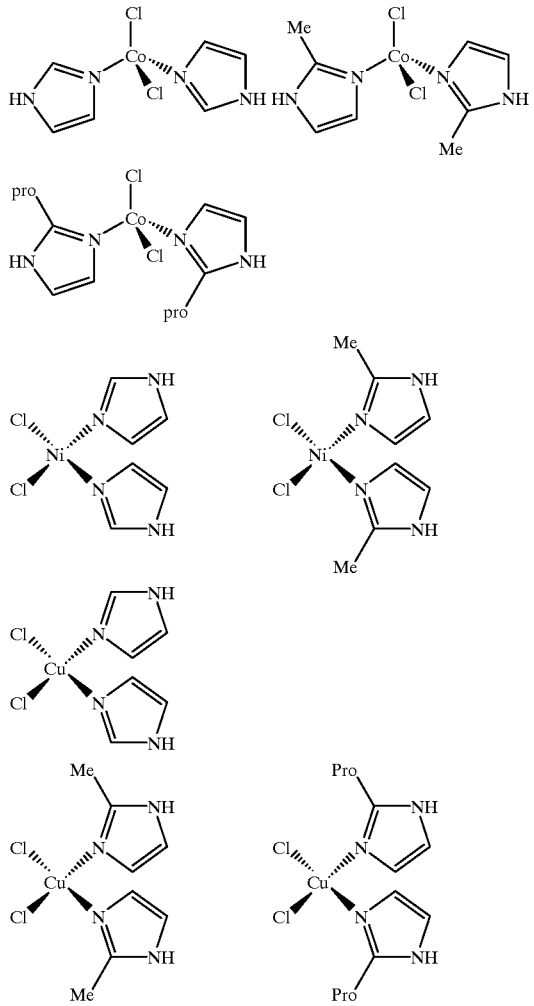

-continued

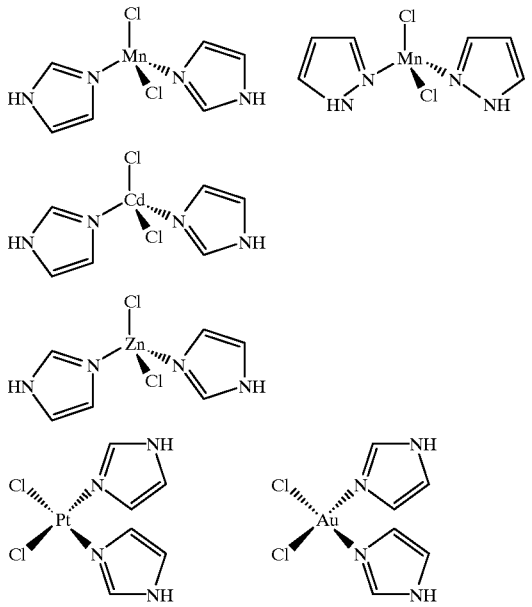

The experiments in the present invention are carried out mainly using Cu(II) complexes and Ni(II) complexes having a square planar structure and Co(II) complexes having a tetrahedron structure. Of these complexes, $[CuCl_2(R—Im)_2]^0$, $[NiCl_2(R—Im)_2]^0$ and $[CoCl_2(R—Im)_2]^0$, wherein R—Im stands for an imidazole compound of formula (III), are used to advantage over the others.

Each of the present complexes can be synthesized using various methods. For instance, the synthesis methods of $[CuCl_2(2\text{-MeIm})_2]^0$, $[NiCl_2(2\text{-MeIm})_2]^0$ and $[CoCl_2(2\text{-MeIm})_2]^0$, (2-MeIm=2-methylimidazole) are described in *J. Chem. Soc.* (A) 1968, 128, and *J. Chem. Soc.* (A) 1967, 757. The other present complexes can be synthesized referring to those methods and introducing therein modifications depending on each complex. Additionally, the synthesis of $[CoCl_2(thia)_2]^0$ (thia=thiazole) used as a comparative example is also described in *J. Chem. Soc.* (A) 1967, 757.

Each of the metal complexes used to advantage in the present invention is an electric charge-free complex (i.e., an electric chargeless complex) having a divalent metal as the central metal (ion) and two chlorine ions bonded thereto. Of course, the complexes having electric charges can also be used in the present invention. In this case, each complex molecule may be either a cation or an anion, and forms a complex salt together with a counter ion. As such a complex salt dissociates completely into a complex ion and a counter ion in an aqueous solution, the counter ion is of no great importance so far as photographic properties are concerned. When the complex molecule is an anion and forms a complex salt together with a counter cation, however, it is desirable to use as the counter cation an alkali metal ion, such as sodium ion, potassium ion, rubidium ion or cesium ion, an ammonium ion or an alkylammonium ion of the following formula (IV) from the viewpoints of solubility in water and suitability for precipitation procedure of silver halide emulsions:

$$[R_5R_6R_7R_8N]^+ \quad \text{(IV)}$$

wherein $R_5$, $R_6$, $R_7$ and $R_8$ represent each a substituent group selected from the group consisting of a methyl group, an ethyl group, a propyl group, an isopropyl group and a n-butyl group. Of these alkylammonium ions, the ions in which $R_5$, $R_6$, $R_7$ and $R_8$ are the same alkyl group, specifically tetramethylammonium ion, tetraethylammonium ion, tetrapropylammonium ion and tetra(n-butyl)ammonium ion, are preferred.

When the complex molecule is a cation and forms a complex salt together with a counter anion, it is desirable to use, as the counter anion, halogen ion, nitrate ion, perchlorate ion, tetrafluoroborate ion, hexafluorophosphate ion, tetra-phenylborate ion, hexafluorosilicate ion, trifluoromethanesulfonate ion or the like from the viewpoints of solubility in water and suitability for precipitation procedure of silver halide emulsions. On the other hand, the use of cyano, thiocyano, nitrite or oxalate ion as the counter anion is undesirable because it is very likely that the ligand exchange reaction occurs between such ions and halogen ions used as ligands in the present complexes to make it difficult for the present complexes to retain their compositions and structures.

In the compounds of the foregoing formula (III) used as ligands of the present complexes, each of the substituent groups $R_1$, $R_2$, $R_3$ and $R_4$ can be a hydrogen atom, a substituted or unsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, methanesulfonylamino-methyl), an alkenyl group, an alkynyl group, an aralkyl group, a cycloalkyl group (e.g., cyclohexyl, 4-t-butylcyclohexyl), a substituted or unsubstituted aryl group (e.g., phenyl, p-tolyl, p-anisyl, p-chlorophenyl, 4-t-butylphenyl, 2,4-di-t-amylphenyl), a halogen atom (e.g., fluorine, chlorine, bromine, iodine), a cyano group, a nitro group, a mercapto group, a hydroxy group, an alkoxy group (e.g., methoxy, butoxy, methoxyethoxy, dodecyloxy, 2-ethylhexyloxy), an aryloxy group (e.g., phenoxy, p-tolyloxy, p-chlorophenoxy, 4-t-butyl-phenoxy), an alkylthio group, an arylthio group, an acyloxy group, a sulfonyloxy group, a substituted or unsubstituted amino group (e.g., amino, methylamino, dimethylamino, anilino, N-methylanilino), an ammonio group, a carbonamido group, a sulfonamido group, an oxycarbonylamino group, an oxysul-fonylamino group, a substituted ureido group (e.g., 3-methylureido, 3-phenylureido, 3,3-dibutylureido), a thio-ureido group, an acyl group (e.g., formyl, acetyl), an oxycarbonyl group, a substituted or unsubstituted carbamoyl group (e.g., ethylcarbamoyl, dibutylcarbamoyl, dodecyloxypropylcarbamoyl, 3-(2,4-di-t-amylphenoxy)propylcarbamoyl, piperidinocarbonyl, morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid group or a salt thereof, a sulfonic acid group or a salt thereof, or a phosphoric acid group or a salt thereof. In addition, $R_2$ and $R_3$ may be subject to ring closure with each other to form a saturated carbon ring, an aromatic hydrocarbon ring or a heterocyclic aromatic ring. Of the groups as described above, the alkyl groups, such as methyl, ethyl and n-propyl groups, are preferred in particular.

In the next place, the complexes represented by the foregoing formula (II) are described in detail.

The central metal M in formula (II) is preferably a metal ion selected from the group consisting of ruthenium, titanium, manganese, platinum and tin ions. In particular, the complexes in which n is 4 and X is $Cl^-$ are used to advantage in the present invention.

To the ligands of formula (III) present in the complexes of formula (II), the same illustration as provided in the case of the complexes represented by formula (I) can be given.

Specific examples of a complex of formula (II) according to the present invention are illustrated below, but it should be understood that these examples are not to be construed as limiting the scope of the invention in any way. Additionally, the symbols Me and Pro in the following structural formulae stand for methyl and propyl groups respectively.

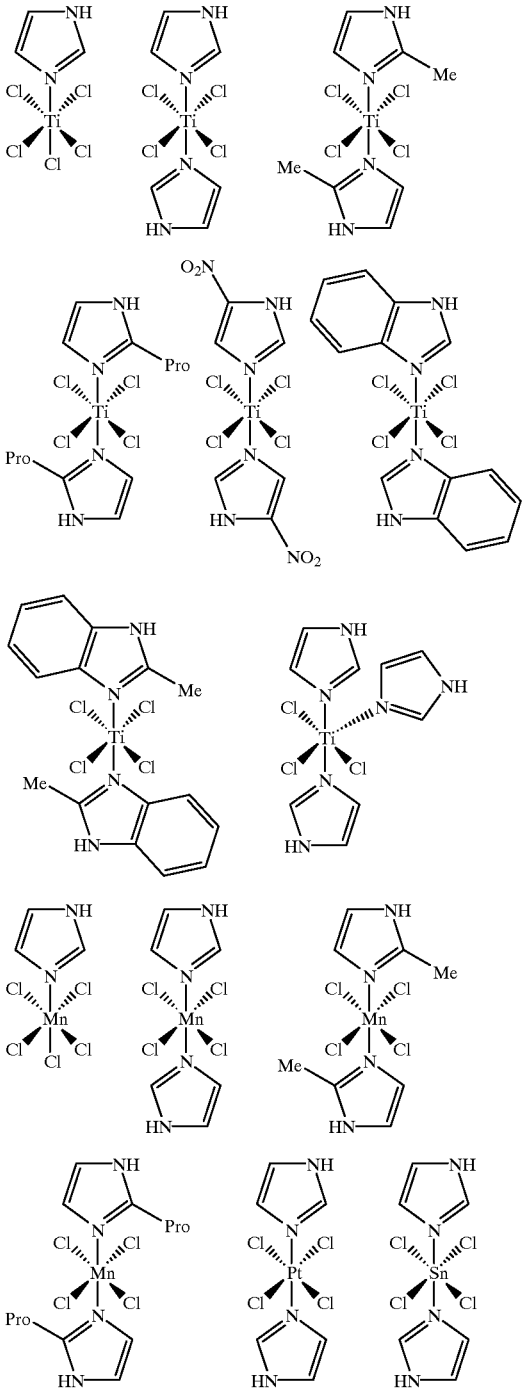

-continued

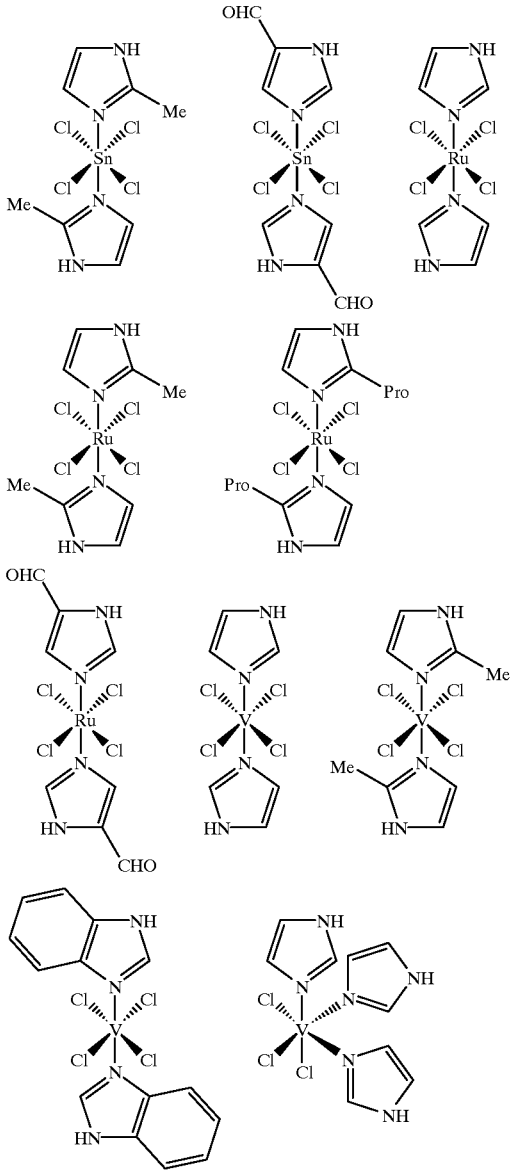

The central metals of the metal complexes of formula (II) which can be used to advantage in the present invention are ruthenium(III), titanium(IV), manganese(II), platinum(IV) and tin(IV) . In each complex, four chlorine ions are bonded to the central metal, and so the titanium(IV) complexes, the platinum(IV) complexes and tin(IV) complexes are electric charge-free complexes. Although they have no electric charge, these tetravalent metal-containing complexes are soluble in water. As the titanium(IV) complexes, it is desirable to handle them in a nonaqueous solvent, such as alcohol, because of the deliquescence property. In order to elevate the solubility of an electric charge-free complex in water, it is possible to let the complex molecule have an electric charge by changing the valency of the central metal from tetravalent to trivalent or another. On the other hand, the charges of the ruthenium(III) complexes and the manganese(II) complexes are determined by the valency of the central metal so that the ruthenium(III) complexes and the manganese(II) complexes become each minus-monovalent (i.e., monovalent anionic) and minus-divalent (i.e., divalent anionic) complexes. The complex molecule charged as described above is completely dissociated from its counter ion in an aqueous solution.

Accordingly, the counter ion is not important on the photographic characteristics. However, the counter ion plays an important part when the synthesized complex is isolated, when the solubility against is considered, and when the stability of the complex in the solution is considered. When the complex molecule is an anion and forms a complex salt together with a counter cation, it is desirable to use as the counter cation an alkali metal ion, such as sodium ion, potassium ion, rubidium ion or cesium ion, an ammonium ion or an alkylammonium ion of the foregoing formula (IV) from the viewpoints of solubility in water and suitability for precipitation procedure of silver halide emulsions.

The present complexes of formula (II) can be synthesized by various methods. For instance, the titanium complexes and the tin complexes can be obtained by allowing titanium tetrachloride or tin tetrachloride respectively to react with imidazole (derivative) compounds while cooling the reaction system. To be more concrete, the methods of synthesizing (bisimidazole)-titanium tetrachloride and (bisimidazole)tin tetrachloride are described in *J. Gen. Chem. USSR,* 1967, 36, 1078, and the other titanium and tin complexes also can be synthesized using the methods similar thereto. In addition, the syntheses of tetrachloro-manganese-complexes, tetrachloro-platinum-complexes and tetrachloro-ruthenium-complexes having imidazole ligands are described in *J. Inst. Chem.* (*India*), 1989, 61, 129, *Russ. J. Inorg. Chem.,* 1981, 26, 1179, and *Inorg. Chem.,* 1987, 26, 844, respectively. The derivatives of those complexes can also be prepared using methods similar to those described in the above-cited references respectively.

It is desirable for each of the present complexes represented by formulae (I) and (II) respectively to be incorporated into silver halide grains by direct addition to a reaction solution at the step of forming silver halide grains, or by addition to a solution for grain-forming reaction via the addition to an aqueous halide or another solution for forming silver halide grains. Also, the combination of these methods may be adopted for doping silver halide grains. In the case of titanium complexes, it is most desirable that the complexes be dissolved in a small amount of methanol or ethanol solution independently of aqueous silver nitrate and halide solutions and then added to a reaction solution simultaneously with the addition of aqueous silver nitrate and halide solutions.

The suitable amount of a dopant used is from $1\times10^{-10}$ to $1\times10^{-3}$ mole (preferably from $1\times10^{-8}$ to $1\times10^{-4}$ mol), per mole of silver halide when the dopant is a complex of formula (I), while it is from $1\times10^{-8}$ to $1\times10^{-3}$ mole (preferably $1\times10^{-7}$ to $1\times10^{-4}$ mol), per mole of silver halide when the dopant is a complex of formula (II).

The silver halide emulsions used in the present silver halide photographic materials have no particular restriction as to the silver halide, but any of silver chloride, silver chlorobromide, silver bromide, silver iodochloride and silver iodobromide can be used therein. Whichever halide composition the grains used as host have, the present complexes used as dopant can have sensitivity-increasing effect on the grains, though there is quantitative difference in the effect among them. Therefore, the grains used in an emulsion are generally subject to no restriction on the halide composition. The suitable grain size of silver halide is at least 0.1 $\mu$m, preferably from 0.3 to 3 $\mu$m.

The silver halide grains may have a regular crystal form, an irregular crystal form, or any kind of crystal form wherein at least one twin plane is present. Examples of a regular crystal form include the crystal forms of a cube, an octahedron, a dodecahedron, a tetradecahedron, an eicosahedron and an octatetracontahedron, while those of an irregular crystal form include a spherical crystal form and a pebble-like crystal form. Examples of a crystal form having at least one twin plane include those of a tabular hexagon and a tabular triangle which each have two or three parallel twin planes. It is desirable for the grains having such tabular forms to be monodisperse with respect to the grain size distribution. The preparation of monodisperse tabular grains is described in JP-A-63-11928. The description of monodisperse tabular hexagonal grains is found in JP-A-63-151618. The monodisperse tabular circular grain emulsion is described in JP-A-1-131541. Further, JP-A-2-838 discloses the emulsion wherein at least 95%, based on projected area, of the total grains are tabular grains having two twin planes parallel to the principal plane and the size distribution of these tabular grains is monodisperse. EP-A-0514742 discloses the tabular grain emulsion prepared in the presence of a polyalkylene oxide block polymer and thereby achieving a variation coefficient of 10% or below with respect to the grain size distribution.

There are known the tabular grains whose major surfaces are (100) planes and the tabular grains whose major surfaces are (111) planes, both of which the technique of the present invention can be applied to. The silver bromide of the former type are disclosed in U.S. Pat. No. 4,063,951 and JP-A-5-281640, while the silver chloride of the former type are disclosed in EP-A-0534395 and U.S. Pat. No. 5,264,337. The tabular grains of the latter type can have various shapes wherein at least one twin plane is present, and those of silver chloride are described in U.S. Pat. Nos. 4,399,215, 4,983,508 and 5,183,732, JP-A-3-137632 and JP-A-3-116113.

The silver halide grains may have dislocation lines on the inside. The technique of introducing dislocations into silver halide grains under careful control is disclosed in JP-A-63-220238. According to this gazette, the dislocation can be introduced by forming a particular phase having a high iodide content inside the tabular silver halide grains having an average grain diameter/grain thickness ratio of at least 2 and covering the outside with a phase lower in iodide content than the aforesaid phase having a high iodide content. The introduction of such a dislocation can produce various effects, including an increase in sensitivity, improvement in keeping quality, a rise in latent image stability and reduction in pressure mark. According to the invention of the reference cited above, the dislocations are introduced mainly in the edge part of tabular grains. on the other hand, the tabular grains having dislocations introduced in the core part are disclosed in U.S. Pat. No. 5,238,796. Further, the grains having a regular crystal form and dislocations on the inside are disclosed in JP-A-4-348337. And this gazette discloses that the dislocations can be introduced by forming epitaxies of silver chloride or silver chlorobromide on the grains having a regular crystal form and subjecting the epitaxies to physical ripening and/or halogen conversion. By the introduction of dislocations in such a way, the effects of increasing sensitivity and decreasing pressure mark are obtained. The dislocation lines in silver halide grains can be observed by the direct method using a transmission electron microscope at a low temperature as described in, e.g., J. F.

Hamilton, *Photo, Sci. Eng.,* vol. 11, p. 57 (1967) and T. Shinozawa, *J. Soc. Photo Sci. JAPAN,* vol. 35, p. 213 (1972). More specifically, the silver halide grains separated from an emulsion, taking care that they don't receive such pressure as to cause dislocation therein, are put on a mesh for observation with an electron microscope, and observed using a transmission method as they are cooled for protection against damage by electron beams (printout). Therein, the greater the grain thickness, the harder the transmission of electron beams, so that clear observation can be made by the use of high-voltage electron microscope (at least 200 kV to a grain thickness of 0.25 $\mu$m). From the electron micrographs of grains obtained by the aforementioned method can be determined the positions and the number of dislocation lines in each grain viewed from the plane perpendicular to the principal plane. The present invention can achieve its effects when at least 50% of the total silver halide grains are grains in which at least 10 dislocation lines per grain are present.

The preparation of silver halide emulsions has no particular restrictions on additives used from the grain formation step till the coating step. For the purpose of promoting the crystal growth in the crystal-forming step or achieving effective chemical sensitization at the time of grain formation and/or chemical sensitization, silver halide solvents can be utilized. As silver halide solvents, it is possible to use water-soluble thiocyanates, ammonia, thioethers and thioureas. More specifically, the thiocyanates disclosed in U.S. Pat. Nos. 2,222,264, 2,448,534 and 3,320,069, ammonia, the thioether compounds disclosed in U.S. Pat. Nos. 3,271,157, 3,574,628, 3,704,130, 4,297,439 and 4,276,347, the thion compounds disclosed in JP-A-53-144319, JP-A-53-82408 and JP-A-55-77737, the amine compounds disclosed in JP-A-54-100717, the thiourea derivatives disclosed in JP-A-55-2982, the imidazoles disclosed in JP-A-54-100717 and the substituted mercaptotetrazoles disclosed in JP-A-57-202531 can be recited as usable silver halide solvents.

The silver halide emulsions used in the present invention has no particular restriction on their preparation methods. In general, aqueous silver salt and halide solutions are added to a reaction solution including an aqueous gelatin solution with efficient agitation. The methods usable therein are described in, e.g., P. Glafkides, *Chemie et Physique Photographique,* Paul Montel (1967), G. G. Dufin, *Photographic Emulsion Chemistry,* The Focal Press (1966), V. L. Zelikman, et al., *Making and Coating Photographic Emulsion,* The Focal Press (1964). More specifically, the emulsions may be prepared by any of acid, neutral and ammoniacal methods, and the methods employed for reacting a water-soluble silver salt with a water-soluble halide may be any of a single jet method, a double jet method and a combination thereof. Further, the so-called controlled double jet method, wherein the pAg of the liquid phase in which silver halide grains be precipitated is maintained constant, may be employed. In addition, it is also desirable that the emulsion grains be made to grow at the highest speed under the critical supersaturation limit by the use of the method of altering the addition speeds of aqueous silver nitrate and alkali halide solutions in proportion to the grain growth speed (as disclosed in U.K. Patent 1,535,016, JP-B-48-36890 and JP-B-52-16364) or the method of changing the concentrations of aqueous solutions (as described in U.S. Pat. No. 4,24,445 and JP-A-55-158124). These methods can be employed to advantage, because they cause no renucleation and ensure uniform growth of silver halide grains.

In another method which can be used to advantage, previously prepared fine grains are added to a reaction vessel instead of adding a silver salt solution and a halide solution to a reaction vessel, thereby causing nucleation and/or grain growth to prepare silver halide grains. The techniques concerning this method are disclosed in JP-A-1-183644, JP-A-1-183645, JP-A-2-44335, JP-A-2-43534, JP-A-2-43535 and U.S. Pat. No. 4,879,208. According to this method, the halogen ion distribution inside the emulsion grains can be uniform throughout to provide desirable photographic characteristics.

On the other hand, emulsion grains having various structures can also be employed in the present invention. For instance, the grains constituted of the inner part (core part) and the outside thereof (shell part), or the grains having the so-called core/shell double-layered structure, the grains having a triple-layered structure (disclosed in JP-A-60-222844) and the grains having a multi-layer structure can be used. In a case where emulsion grains are formed so as to have an internal structure, the internal structure may be not only the wrapped-in structure as described above but also the so-called joined structure as disclosed in JP-A-58-108526, JP-A-59-16254, JP-A-59-133540 JP-B-58-24772 and EP-A2-0199290. Specifically, each host crystal joins crystallites differing therefrom in composition at its edge(s), corner(s) or face(s), and the crystallites are made to grow on the joined site(s) to form a crystal having a joined structure. In forming such crystals joined, the host crystal may have a uniform halide composition or a core/shell structure. In the case of forming a joined structure, though crystals of silver halide can be joined together as a matter of course, another silver salt compound having a structure other than the rock salt structure, such as silver thiocyanate or silver carbonate, may also be used so long as it can attain an epitaxic growth on silver halide crystals.

In the case of silver iodobromide grains having an internal structure, e.g., a core/shell structure, the iodide content may be high in the core part and low in the shell part, or vice versa. As the silver iodobromide grains having a joined structure, the iodide content may be high in the host crystal and relatively low in the crystal joined to the host crystal, or vice versa. When the grains have an internal structure as mentioned above, a boundary between the parts differing in halide composition may have a clear interface, or may be rendered obscure by forming mixed crystals depending on the difference in halide composition. Also, a continuous change in structure may occur in the boundary region.

The silver halide emulsions used in the present invention may undergo the treatment for rounding the emulsion grains (as disclosed in EP-B1-0096727 or EP-B1-0064412) or modifying the grain surface (as disclosed in German Patent 2306447 C2 or JP-A-60-221320). And a surface latent image-type silver halide emulsion is preferred in the present invention. However, as disclosed in JP-A-59-133542, it is also possible to use an internal latent image type silver halide emulsion so far as the developer or developing condition is chosen properly. Further, a shallow internal latent image-type emulsion which is covered with a thin shell can be employed depending on the intended use.

In general, the silver halide emulsions are spectrally sensitized. Spectral sensitizing dyes usually employed therefor are methine dyes, including cyanine dyes, merocyanine dyes, composite cyanine dyes, composite merocyanine dyes, holopolarr cyanine dyes, hemicyanine dyes, styryl dyes and hemioxonol dyes. Any rings usually present in cyanine dyes can be the basic heterocyclic rings of these dyes. Suitable examples of a basic heterocyclic ring include pyrroline, oxazoline, thiazoline, pyrrole, oxazole, thiazole, selenazole, imidazole, tetrazole and pyridine rings. In addition, rings formed by condensing together a hetero ring as described above and an alicyclic hydrocarbon ring, and rings formed by condensing together a hetero ring as described above and an aromatic hydrocarbon ring can also be utilized. Examples of such a condensed ring include indolenine, benzindolenine, indole, benzoxazole, naphthoxazole, benzothiazole, naphthothiazole, benzoselenaazole, benzimidazole and quinoline rings. Each of these rings may have a substituent group on any of carbon atoms as the constituent atoms thereof. The merocyanine and composite merocyanine dyes can contain 5- or 6-membered heterocyclic rings, such as pyrazoline-5-one, thiohydantoin, 2-thioxazolidine-2,4-dione, thiazolidine-2,4-dione, rhodanine and thiobarbituric acid rings, as ketomethylene structure-containing rings.

The suitable amount of sensitizing dyes added is from 0.001 to 100 millimole, preferably from 0.01 to 10 millimole, per mole of silver halide. It is desirable for the sensitizing dyes to be added during chemical sensitization or before chemical sensitization (e.g., at the time of grain formation or physical ripening).

In the present invention, the sensitivity to light of the wavelengths at which the chemically sensitized silver halide grains show their intrinsic absorption (namely the intrinsic sensitivity) is improved. More specifically, a decrease in the sensitivity to light of wavelengths longer than about 450 nm which is attributable to the adsorption of spectral sensitizing dyes to the surfaces of silver halide grains, namely the intrinsic desensitization due to sensitizing dyes, can be lessened by the doping with a complex of formula (I). In other words, besides the effect of increasing the intrinsic sensitivity of silver halide, the present invention has a beneficial effect upon the prevention of the intrinsic desensitization due to sensitizing dyes.

To silver halide emulsions may be added dyes which, although they themselves do not spectrally sensitize silver halide emulsions, or materials which, although they do not absorb light in the visible region, can exhibit a supersensitizing effect in combination with a certain sensitizing dye. Examples of such dyes or materials include aminostilbene compounds substituted by nitrogen-containing heterocyclic groups (as disclosed in U.S. Pat. Nos. 2,933,390 and 3,635,721), aromatic organic acid-formaldehyde condensates (as disclosed in U.S. Pat. No. 3,743,510) and cadmium sallts and azaindene compounds. The combinations of spectral sensitizing dyes with the dyes or materials as described above are disclosed in U.S. Pat. Nos. 3,615,613, 3,615,641, 3,617,295 and 3,635,721.

In general, the silver halide emulsions used in the present invention are chemically sensitized emulsions. For chemical sensitization, chalcogen sensitization (including sulfur sensitization, selenium sensitization and tellurium sensitization), noble metal sensitization (including gold sensitization) and reduction sensitization can be employed individually or as a combination of at least two thereof. In sulfur sensitization, labile sulfur compounds are used as sensitizer. Examples of such labile sulfur compounds are described in P. Glafkides, *Chimie et Physique Photographigue,* 5th ed., Paul Montel (1987), *Research Disclosure* vol. 307, No. 307105, T. H. James, *The Theory of The Photographic Process,* 4th ed., Macmillan (1977), and H. Frieser, *Die Gründlagender Photographischen Prozess mit Silver-Halogeniden.* Akademische Verlagsgeselbshaft (1968).

Examples of suitable sulfur sensitizers which can be used include thiosulfates (such as sodium thiosulfate and p-toluenethiosulfonate), thioureas (such as diphenylthiourea, triethylthiourea, N-ethyl-N'-(4-methyl-2-thiazolyl)thiourea and carboxymethyltrimethyl-thiourea), thioamides (such as thioacetamide and N-phenylthioacetamide), rhodanines (such as rhodanine, N-ethylrhodanine, 5-benzylidenerhodanine, 5-benzylidene-N-ethylrhodanine and diethylrhodanine), phosphine sulfides (such as trimethylphosphinesulfide) thiohydantoins, 4-oxo-oxazolidine-2-thiones, dipolysulfides (such as dimorpholine disulfide, and cystine), mercapto compounds (such as cysteine), polythionates and elemental sulfur. Also, active gelatins can be utilized as sulfur sensitizer.

In selenium sensitization, labile selenium compounds are used as sensitizer. Such labile selenium compounds are disclosed in JP-B-43-13489, JP-B-44-15748, JP-A-4-25832, JP-A-4-109240, JP-4-271341 and JP-A-5-40324. Examples of suitable selenium sensitizers which can be used include colloidal metallic selenium, selenoureas (such as N,N-dimethylselenourea, trifluoromethylcarbonyl-trimethylselenourea and acetyl-trimethylselenourea), selenoamides (such as selenoacetamide and N,N-diethylphenylselenoamide), phosphine selenides (such as triphenylphosphine selenide and pentafluorophenyltriphenylphosphine selenide), selenophosphates (such as tri-p-tolylselenophosphate and tri-n-butyl-selenophosphate), selenoketones (such as selenobenzophenone), isoselenocyanates, selenocarboxylic acids, selenoesters and diacylselenides. In addition, moderately stable selenium compounds (as disclosed in JP-B- 46-4553 and JP-B-52-34492), including selenious acid, potassium selenocyanate, selenazoles and selenides, can also be utilized as selenium sensitizers.

In tellurium sensitization, labile tellurium compounds are used as sensitizer. Such labile tellurium compounds are disclosed in Canadian Patent 800,958, U.K. Patents 1,295,462 and 1,396,696, JP-A-4-204640, JP-A-4-271341, JP-A-4-333043 and JP-A-5-303157. Examples of suitable tellurium sensitizers which can be used include telluroureas (such as tetra-metnhyltellurourea, N,N'-dimethylethylenetellurourea and N,N'-diphenylethylenetellurourea), phosphine tellurides (such as butyldiisopropylphosphine telluride, tributyl-phosphine telluride, tributoxyphosphine telluride and ethoxydiphenylphosphine telluride), diacyl(di)tellurides (such as bis(diphenylcarbamoyl) ditelluride, bis(N-phenyl-N-methylcarbamoyl) ditelluride, bis(N-phenyl-N-methylcarbamoyl) telluride and bis(ethoxycarbonyl)telluride), isotellurocyanates (such as allylisotellurocyanate), telluroketones (such as telluroacetone and telluroacetophenone), telluroamides (such as telluroacetamide and N,N-dimethyltellurobenzamide), tellurohydrazides (such as N,N',N'-trimethyltellurobenzohydrazide), telluroesters (such as t-butyl-t-hexyltelluroester), collidal tellurium, (di)tellurides and other tellurium compounds (such as potassium telluride and sodium telluropentathionate).

In noble metal sensitization, the salts of noble metals, such as gold, platinum, palladium and iridium, are used as sensitizer. Such moble metal salts are described in, e.g., P. Glafkides, *Chimie et Physique Photographigue,* 5th ed., Paul Montel (1987), and *Research Disclosure,* vol. 307, No. 307105. In particular, gold sensitization is preferred. Examples of gold compounds suitable for gold sensitization include chloroauric acid, potassium chloroaurate, potassium aurithiocyanate, gold sulfide and gold selenide. In addition, the gold compounds disclosed in U.S. Pat. Nos. 2,642,361, 5,049,484 and 5,049,485 can also be used as gold sensitizer.

In reduction sensitization, reducing compounds are used as sensitizer. Such reducing compounds are described in, e.g., P. Grafkides, *Chimie et Physuque Photographique,* 5th ed., Paul Montel (1987), and *Research Disclosure,* vol. 307, No. 307105. Examples of suitable reduction sensitizers which can be used include aminoiminomethanesulfinic acid (thiourea dioxide), borane compounds (such as dimethylamine borane), hydrazine compounds (such as hydrazine and p-tolylhydrazine), polyamine compounds (such as diethylenetriamine and triethylene-tetramine), stannous chloride, silane compounds, reductones (such as ascorbic acid), sulfites, aldehyde compounds and hydrogen. In addition, reduction sensitization can be carried out in an atmosphere of high pH or excess silver ions (the so-called silver ripening).

Two or more kinds of chemical sensitization may be carried out in combination. In particular, the combination of chalcogen sensitization and gold sensitization is preferred over the others. Further, it is desirable that the reduction sensitization be carried out in the step of forming silver halide grains. The amount of each sensitizer used is generally determined depending on what type of silver halide grains are sensitized and what condition is adopted for the chemical sensitization. Specifically, the amount of a chalcogen sensitizer used is generally from $_{10}^{-8}$ to $10^{-2}$ mole, preferably from $10^{-7}$ to $5\times10^{-3}$ mole, per mole of silver halide. The amount of a noble metal sensitizer used is preferably from $10^{-7}$ to $10^{-2}$ mole per mole of silver halide. As to the conditions for chemical sensitization, there are no particular restrictions. However, it is desirable that the pAg be from 6 to 11, preferably from 7 to 10, the pH be from 4 to 10, and the temperature be from 40 to 95° C., preferably 45 to 85° C.

The silver halide emulsions used in the present invention can contain a wide variety of compounds for purposes of preventing fogging or stabilizing photographic properties during production, storage or photographic processing of the present photographic material. Examples of compounds usable for the foregoing purposes include azoles (such as benzothiazolium salts, nitroindazoles, triazoles, benzotriazoles and benzimidazoles (especially those substituted with nitro groups or halogen atoms)), heterocyclic mercapto compounds (such as mercaptothiazoles, mercaptobenzothiazoles, mercaptobenzimidazoles, mercaptothiadiazoles, mercapto-tetrazoles (especially 1-phenyl-5-mercaptotetrazole) and mercaptopyrimidines), imidazoles, the above-described heterocyclic mercapto compounds containing a water-soluble group such as a carboxyl or sulfo group, thioketo compounds (such as oxazolinethione), azaindenes (such as tetraazaindenes (especially 1,3,3a,7-tetraazaindenes substituted with a hydroxyl group at the 4-position), benzenethiosulfonic acids and benzenesulfinic acid. In general, these compounds are known as antifoggants or stabilizers.

The appropriate time for addition of such an antifoggant or stabilizer is generally after chemical sensitization. However, the time for addition may be chosen from any stages during or before chemical sensitization. Specifically, the antifoggants or stabilizers may be added during the addition of a silver salt solution in the process of forming silver halide emulsion grains, or during the period from the conclusion of addition of a silver salt solution to the beginning of chemical sensitization, or during chemical sensitization (preferably during the first half of chemical sensitization, more preferably during the period from the beginning of chemical sensitization to the time corresponding to one fifth of chemical sensitization time).

The present silver halide photographic materials have no particular restrictions as to their layer structures. When they are color photographic materials, however, they have a multi-layer structure for recording blue light, green light and red light separately. Further, each silver halide emulsion layer may be constituted of two layers of a high speed layer and a low speed layer. Examples of a practical layer structure are given below:

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

Therein, B stands for a blue-sensitive layer, G for a green-sensitive layer, R for a red-sensitive layer, H for a highest speed layer, M for a medium speed layer, L for a low speed layer, S for a support, and CL for an interlayer effect-providing layer. Light-insensitive layers, such as a protective layer, a filter layer, an interlayer, an anti-halation layer and a subbing layer, are omitted from the foregoing representation of layer structures. Further, the arranging order of high speed and low speed layers having the same color sensitivity may be reversed. The layer structure (3) is described in U.S. Pat. No. 4,184,876. The layer structure (4) is described in *Research Disclosure,* vol. 225, No. 22534, JP-A-59-177551 and JP-A-59-177552. The layer structures (5) and (6) are described in JP-A-61-34541. The layer structures (1), (2) and (4) are preferred over the others. Besides color photographic materials, the present silver halide photographic materials can be applied to X-ray photographic materials, sensitive materials for black and white photography, sensitive materials for plate-making process and photographic printing paper.

As the various additives usable in the present silver halide emulsions (e.g., binders, chemical sensitizers, spectral sensitizers, stabilizers, gelatin, hardeners, surfactancts, antistatic agents, polymer latexes, matting agents, color couplers, ultraviolet absorbents, discoloration inhibitors, dyes), supports for the present photographic materials and processing methods for the present photographic materials (e.g., coating methods, exposure methods, development-processing methods), the descriptions in *Research Disclosure,* vol. 176, No. 17643 (abbreviated as "RD-17643"), vol. 187, No. 18716 (abbreviated as "RD-18716") and vol. 225, No. 22534 (abbreviated as "RD-22534") can be referred to. The locations where the additives are described in each of those references are listed below.

| Kinds of Additives | RD-17643 | RD-18716 | RD-22534 |
|---|---|---|---|
| 1. Chemical sensitizer | p. 23 | p. 648, right | p. 24 column |
| 2. Sensitivity increasing agent | | p. 648, right column | |
| 3. Spectral sensitizer and Supersensitizer | pp. 23–24 | p. 648, right column, to p. 649, right column | pp. 24–28 |
| 4. Brightening agent | p. 24 | | |
| 5. Antifoggant and Stabilizer | pp. 24–25 | p. 649, right column | p. 24 and p. 31 |
| 6. Light absorbent, Filter dye, UV absorbent | pp. 25–26 | p. 649, right column, to p. 650, left column | |
| 7. Stain inhibitor | p. 25, right column | p. 650, left to right column | |

-continued

| Kinds of Additives | RD-17643 | RD-18716 | RD-22534 |
|---|---|---|---|
| 8. Dye image stabilizer | p. 25 | p. 32 | |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

With respect to the gelatin hardeners, for example, active halogen compounds (such as 2,4-dichloro-6-hydroxy-1,3,5-triazine and sodium salt thereof) and active vinyl compounds (such as 1,3-bisvinylsulfonyl-2-propanol, 1,2-bis (vinylsulfonylacetamido)ethane and vinyl polymers having vinylsulfonyl groups in their chains) are used to advantage because they can quickly harden hydrophilic colloids such as gelatin to provide stable photographic characteristics. In addition, N-carbamoylpyridinium salts (such as (1-morpholinocarbonyl-3-pyridinio)methanesulfonate) and haloamidinium salts (such as 1-(1-chloro-1-pyridinomethylene) pyrrolidinium 2-naphthalenesulfonate) are also excellent hardeners because of their high hardening speed.

The present color photographic materials can be processed using the general methods described in *Research Disclosure,* vol. 176, No. 17643 and ibid., vol. 187, No. 18716. Specifically, the color photographic materials are subjected sequentially to development processing, bleach-fix or fixation processing, and washing or stabilization processing. In the washing step, a counter-current washing method using two or more tanks is generally adopted to effect a water saving. As a typical example of stabilization processing which can take the place of washing processing, the multistage counter-current stabilization processing as disclosed in JP-A-57-8543 can be cited.

The present invention will now be illustrated in greater detail by reference to the following examples, but it should be understood that these examples are not to be construed as limiting the scope of the invention in any way.

EXAMPLE 1

[Emulsion 1: Emulsion Comprising Cubic Silver Chloride Grains]

To 845 ml of an aqueous solution containing 4.5 g of sodium chloride, 25 g of deionized gelatin was added and dissolved therein. To the resulting solution kept at 50° C. with stirring, 140 ml of a 0.21 M aqueous solution of silver nitrate (Solution 1) and 140 ml of a 0.21 M aqueous solution of sodium chloride (Solution 2) were added at a constant flow rate over a 10-minute period with a double jet method. After the 10-minute lapse, 320 ml of a 2.2 M aqueous solution of silver nitrate (Solution 3) and 320 ml of a 2.2 M aqueous solution of sodium chloride (Solution 4) were further added at a constant flow rate over a 35-minute period with a double jet method. After the 5 minute-lapse from the conclusion of the addition, the reaction solution was cooled to 35° C., and the soluble salts were removed therefrom by a general flocculation method. The resulting solution was raised again to 40° C., and additional gelatin was dissolved therein, and further sodium chloride was added thereto. The emulsion thus prepared was adjusted to pH 6.5 by the use of sodium hydroxide. The emulsion grains formed in the foregoing manner were monodispersed silver chloride cubes having an edge length of 0.5 $\mu$m.

[Emulsions 2 to 5 (According to Present Invention): Present Four-coordinate Complex-doped Emulsions]

Emulsions 2 to 5 were each prepared in the same manner as Emulsion 1, except that four dopants selected from the present four-coordinate complexes of formula (I) were each added in a concentration of $2.9\times10^{-6}$ M to the Solution 4 used for preparation of Emulsion 1. In each of these emulsions, the dopant was distributed uniformly throughout the silver halide grains each, excluding the fine-grain part utilized as nucleus.

After admixed with gelatin and sodium dodecylbenzenesulfonate, each of Emulsions 1 to 5 was coated at a silver coverage of 2 g/m$^2$ using an extrusion method on a triacetyl cellulose film support having a subbing layer together with a protective layer containing gelatin, polymethylmethacrylate particles and sodium salt of 2,4-dichloro-6-hydroxy-s-triazine. Thus, coated Samples 1 to 5 were prepared.

Further, each of Emulsions 1 to 5 was spectrally sensitized by adding thereto $3.8\times10^{-4}$ mole/mole-Ag of the following sensitizing dye (1), and coated in the same manner as mentioned above to prepare each of coated Samples 6 to 10 and each of coated Samples 11 to 15.

Sensitizing Dye (1)

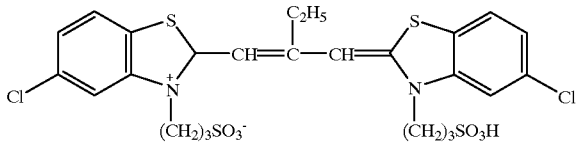

These Samples were each subjected to the exposure for sensitometry (10 seconds) via an optical wedge, and then developed for 5 minutes at 20° C. with Developer 1 prepared according to the formula described below. Thereafter, each sample underwent sequentially stop, fixation, washing and drying operations, and then measured for optical density. The fog density was determined as the minimum optical density of each sample, and the sensitivity was represented by the logarithm of an exposure amount required for providing the optical density of fog +0.1. The sensitivities of Samples are shown as relative values in Table 1, with the dopant-free Sample (which is a conventional type, and so hereinafter referred to as "type") being taken as 100. With respect to the coated Samples 1 to 5 (spectral sensitizing dye-free samples as blank samples) and the coated Samples 6 to 10 (spectral sensitizing dye-added samples), the sensitivity of each samples shown in Table 1 is relative sensitivity determined when the sample was exposed to light of wavelengths at which the silver halide therein showed the intrinsic absorption. On the other hand, the sensitivities of coated Samples 11 to 15 (spectral sensitizing dye-added samples) shown in Table 1 are relative sensitivities determined when the samples were exposed to light of wavelengths corresponding to the absorption by the spectral sensitizing dye. Additionally, the coated Samples 6 to 10 were the same as the coated Samples 11 to 15 respectively. However, the samples corresponding to each other were different in wavelengths of exposure light used for sensitometry although the same emulsion was used therein. Therefore, two different numbers were given to the same sample.

| Developer 1 | |
|---|---|
| Metol | 2.5 g |
| L-Ascorbic acid | 10.0 g |
| Nabox | 35.0 g |
| NaCl | 0.58 g |
| Water to make | 1 liter |
| pH adjusted to | 9.6 |

TABLE 1

| Sample No.*1 | Emulsion No. | Dopant | Relative Sensitivity*2 |
|---|---|---|---|
| 1 (type) | 1 | absent | 100 |
| 2 (invention) | 2 | $[CoCl_2(2\text{-MeIm})_2]$ | 98 |
| 3 (invention) | 3 | $[CuCl_2(2\text{-MeIm})_2]$ | 100 |
| 4 (invention) | 4 | $[CuCl_2(2\text{-proIm})_2]$ | 100 |
| 5 (invention) | 5 | $[NiCl_2(2\text{-MeIm})_2]$ | 100 |
| 6 (type) | 1 | absent | 100 |
| 7 (invention) | 2 | $[CoCl_2(2\text{-MeIm})_2]$ | 98 |
| 8 (invention) | 3 | $[CuCl_2(2\text{-MeIm})_2]$ | 102 |
| 9 (invention) | 4 | $[CuCl_2(2\text{-proIm})_2]$ | 104 |
| 10 (invention) | 5 | $[NiCl_2(2\text{-MeIm})_2]$ | 104 |
| 11 (type) | 1 | absent | 100 |
| 12 (invention) | 2 | $[CoCl_2(2\text{-MeIm})_2]$ | 87 |
| 13 (invention) | 3 | $[CuCl_2(2\text{-MeIm})_2]$ | 97 |
| 14 (invention) | 4 | $[CuCl_2(2\text{-proIm})_2]$ | 107 |
| 15 (invention) | 5 | $[NiCl_2(2\text{-MeIm})_2]$ | 113 |

*1Sample Nos. 1 to 5 were sensitizing dye-free samples, while Sample Nos. 6 to 15 were sensitizing dye-added samples. Sample Nos. 1 to 10 were subjected to blue exposure, while Sample Nos. 11 to 15 were subjected to minus blue exposure.

*2The sensitivities of Sample Nos. 2 to 5 are shown as relative values, with Sample No. 1 being taken as 100; the sensitivities of Sample Nos. 7 to 10 are shown as relative values, with Sample No. 6 being taken as 100; and the sensitivities of Sample Nos. 12 to 15 are shown as relative values, with Sample No. 11 being taken as 100.

As is apparent from the results of Table 1, in the case of exposure to light of wavelengths corresponding to the intrinsic absorption by silver halide, the samples in which the sensitizing dye was absent caused no appreciable change in sensitivity due to the doping mentioned above, while a rise in sensitivity by the doping was observed in the samples in which the sensitizing dye was present. In the case of exposure to light of wavelengths corresponding to the absorption by the sensitizing dye, on the other hand, a clear increase in sensitivity was observed in the samples comprising the $[CuCl_2(2\text{-ProIm})_2]^0$- and $[NiCl_2(2\text{-MeIm})_2]^0$-doped emulsions respectively although distinct desensitization was caused in the sample comprising the $[CoCl_2(2\text{-MeIm})_2]^0$-doped emulsion.

Additionally, in the cases where the emulsions were chemically sensitized, no clear increase in sensitivity by the doping was observed, irrespective of wavelength of exposure light and exposure time.

EXAMPLE 2

[Emulsion 6-a: Emulsion Comprising Cubic Silver Chloride Grains]

Emulsion 6-a was prepared in the same manner as Emulsion 1.

[Emulsion 6-b (for Comparison): Emulsion Comprising Cubic Silver Halide Grains Doped with Square Planar Complex Having Thiazole Ligands]

To 845 ml of a water solution containing 4.5 g of sodium chloride, 25 g of deionized gelatin was added and dissolved therein. To the resulting solution kept at 50° C. with stirring, 140 ml of a 0.21 M aqueous solution of silver nitrate (Solution 1) and 140 ml of a 0.21 M aqueous solution of sodium chloride (Solution 2) were added at a constant flow rate over a 10-minute period with a double jet method. After a 10-minute lapse, 320 ml of a 2.2 M aqueous solution of silver nitrate (Solution 3), 285 ml of a 2.5 M aqueous solution of sodium chloride (Solution 4) and 35 ml of a methanol solution containing $[CoCl_2(thia)_2]^0$ wherein thia stands for thiazole (Solution 5) were further added at a constant flow rate over a 35-minute period with a triple jet method. After a 5 minute-lapse from the conclusion of the addition, the reaction solution was cooled to 35° C., and the soluble salts were removed therefrom by a general flocculation method. The resulting solution was raised again to 40° C., and additional gelatin was dissolved therein, and further sodium chloride was added thereto. The emulsion thus prepared was adjusted to pH 6.5 by the use of sodium hydroxide. The emulsion grains formed in the foregoing manner were monodisperse silver chloride cubes having a side length of 0.5 $\mu$m.

[Emulsions 7 to 12 (According to the Present Invention): Emulsions (2) Comprising Cubic Silver Chloride Grains Doped with Present Square Planar Complexes of Formula (I) Respectively]

Emulsions 7 to 12 were prepared in the same manner as Emulsion 6-b, except that the complex $[CoCl_2(thia)_2]^0$ was replaced by the present six different complexes respectively.

[Emulsions 13 to 18 (According to the Present Invention): Emulsions (3) Comprising Cubic Silver Chloride Grains Doped with Present Square Planar Complexes of Formula (I) Respectively]

Emulsions 13 to 18 were prepared in the same manners as Emulsions 7 to 12 respectively, except that the complex concentration in Solution 5 was changed to $2.0\times10^{-4}$ M.

These emulsions were each coated in the same manner as employed in Example 1 for preparing each of coated Samples 1 to 5, thereby obtaining coated Samples 16 to 22 and coated Samples 37 to 42 respectively.

On the other hand, the emulsions made above were each spectrally sensitized with $3.8\times10^{-4}$ mole/mole-Ag of the same Sensitizing Dye (1) as used in Example 1, and coated in the same manner as employed for preparing the coated Samples 6 to 10, thereby obtaining coated Samples 23 to 36 and 43 to 54 respectively.

Similarly to Example 1, these samples were each subjected to exposure for sensitometry (for 10 seconds) via an optical wedge, developed for 5 minutes at 20° C., and further subjected sequentially to usual stop, fixation, washing and drying operations. The samples thus processed were each measured for optical density. The results obtained using Emulsions 6 to 12 respectively are shown in Table 2, and those obtained using Emulsions 13 to 18 respectively are shown in Table 3. In Table 2 are shown the relative sensitivities of the coated Samples 16 to 22 (spectral sensitizing dye-free samples) and the coated Samples 23 to 29 (spectral sensitizing dye-added samples) respectively when exposed to light of wavelengths corresponding to the intrinsic absorption of silver halide and the relative sensitivities of the coated Samples 31 to 36 (spectral sensitizing dye-added samples) respectively when exposed to light of wavelengths corresponding to the absorption by the spectral sensitizing dye. In Table 3 are further shown the relative sensitivities of the coated Samples 37 to 42 (spectral sensitizing dye-free samples) and the coated Samples 43 to 48 (spectral sensitizing dye-added samples) respectively when exposed to light of wavelengths corresponding to the intrinsic absorption of silver halide and the relative sensitivities the coated Samples 49 to 54 (spectral sensitizing dye-added samples)

respectively when exposed to light of wavelengths corresponding to the absorption by the spectral sensitizing dye. Additionally, the results of the coated Samples 16, 23 and 30 are shown together in Table 3 as those of samples of conventional type.

TABLE 2

| Sample No.*1 | Emulsion No. | Dopant | Relative Sensitivity*2 |
|---|---|---|---|
| 16-a (type) | 6-a | absent | 100 |
| 16-b (comparison) | 6-b | $[CoCl_2(thia)_2]$ | 97 |
| 17 (invention) | 7 | $[CoCl_2(Im)_2]$ | 100 |
| 18 (invention) | 8 | $[CoCl_2(2\text{-}MeIm)_2]$ | 101 |
| 19 (invention) | 9 | $[CoCl_2(2\text{-}ProIm)_2]$ | 102 |
| 20 (invention) | 10 | $[CuCl_2(2\text{-}MeIm)_2]$ | 100 |
| 21 (invention) | 11 | $[CuCl_2(2\text{-}proIm)_2]$ | 100 |
| 22 (invention) | 12 | $[NiCl_2(2\text{-}MeIm)_2]$ | 108 |
| 23-a (type) | 6-a | absent | 100 |
| 23-b (comparison) | 6-b | $[CoCl_2(thia)_2]$ | 100 |
| 24 (invention) | 7 | $[CoCl_2(Im)_2]$ | 104 |
| 25 (invention) | 8 | $[CoCl_2(2\text{-}MeIm)_2]$ | 108 |
| 26 (invention) | 9 | $[CoCl_2(2\text{-}proIm)_2]$ | 103 |
| 27 (invention) | 10 | $[CuCl_2(2\text{-}MeIm)_2]$ | 99 |
| 28 (invention) | 11 | $[CuCl_2(2\text{-}proIm)_2]$ | 99 |
| 29 (invention) | 12 | $[NiCl_2(2\text{-}MeIm)_2]$ | 102 |
| 30-a (type) | 6-a | absent | 100 |
| 30-b (comparison) | 6-b | $[CoCl_2(thia)_2]$ | 108 |
| 31 (invention) | 7 | $[CoCl_2(Im)_2]$ | 130 |
| 32 (invention) | 8 | $[CoCl_2(2\text{-}MeIm)_2]$ | 137 |
| 33 (invention) | 9 | $[CoCl_2(2\text{-}proIm)_2]$ | 125 |
| 34 (invention) | 10 | $[CuCl_2(2\text{-}MeIm)_2]$ | 122 |
| 35 (invention) | 11 | $[CuCl_2(2\text{-}proIm)_2]$ | 113 |
| 36 (invention) | 12 | $[NiCl_2(2\text{-}MeIm)_2]$ | 120 |

*1Sample Nos. 16 to 22 were sensitizing dye-free samples, while Sample Nos. 23 to 36 were sensitizing dye-added samples. Sample Nos. 16 to 29 were subjected to blue exposure, while Sample Nos. 3 to 36 were subjected to minus blue exposure.
*2The sensitivities of Sample Nos. 17 to 22 are shown as relative values, with Sample No. 16-a being taken as 100; the sensitivities of Sample Nos. 24 to 29 are shown as relative values, with Sample No. 23-a being taken as 100; and the sensitivities of Sample Nos. 31 to 36 are shown as relative values, with Sample No. 30-a being taken as 100.

TABLE 3

| Sample No.*1 | Emulsion No. | Dopant | Relative Sensitivity*2 |
|---|---|---|---|
| 16 (type) | 6 | absent | 100 |
| 37 (invention) | 13 | $[CoCl_2(Im)_2]$ | 100 |
| 38 (invention) | 14 | $[CoCl_2(2\text{-}MeIm)_2]$ | 100 |
| 39 (invention) | 15 | $[CoCl_2(2\text{-}proIm)_2]$ | 100 |
| 40 (invention) | 16 | $[CuCl_2(2\text{-}MeIm)_2]$ | 99 |
| 41 (invention) | 17 | $[CuCl_2(2\text{-}proIm)_2]$ | 99 |
| 42 (invention) | 18 | $[NiCl_2(2\text{-}MeIm)_2]$ | 105 |
| 23 (type) | 6 | absent | 100 |
| 43 (invention) | 13 | $[CoCl_2(Im)_2]$ | 100 |
| 44 (invention) | 14 | $[CoCl_2(2\text{-}MeIm)_2]$ | 103 |
| 45 (invention) | 15 | $[CoCl_2(2\text{-}proIm)_2]$ | 101 |
| 46 (invention) | 16 | $[CuCl_2(2\text{-}MeIm)_2]$ | 98 |
| 47 (invention) | 17 | $[CuCl_2(2\text{-}proIm)_2]$ | 98 |
| 48 (invention) | 18 | $[NiCl_2(2\text{-}MeIm)_2]$ | 103 |
| 30 (type) | 6 | absent | 100 |
| 49 (invention) | 13 | $[CoCl_2(Im)_2]$ | 123 |
| 50 (invention) | 14 | $[CoCl_2(2\text{-}MeIm)_2]$ | 124 |
| 51 (invention) | 15 | $[CoCl_2(2\text{-}proIm)_2]$ | 109 |
| 52 (invention) | 16 | $[CuCl_2(2\text{-}MeIm)_2]$ | 112 |
| 53 (invention) | 17 | $[CuCl_2(2\text{-}proIm)_2]$ | 110 |
| 54 (invention) | 18 | $[NiCl_2(2\text{-}MeIm)_2]$ | 128 |

*1Sample Nos. 16 and 37 to 42 were sensitizing dye-free samples, while Sample Nos. 23, 30 and 43 to 54 were sensitizing dye-added samples. Sample Nos. 16, 23 and 37 to 48 were subjected to blue exposure, while Sample Nos. 30 and 49 to 54 were subjected to minus blue exposure.

TABLE 3-continued

| Sample No.*1 | Emulsion No. | Dopant | Relative Sensitivity*2 |
|---|---|---|---|

*2The sensitivities of Sample Nos. 37 to 42 are shown as relative values, with Sample No. 16 being taken as 100; the sensitivities of Sample Nos. 43 to 48 are shown as relative values, with Sample No. 23 being taken as 100; and the sensitivities of Sample Nos. 49 to 54 are shown as relative values, with Sample No. 30 being taken as 100.

While the doping of the emulsion in Example 1 was carried out by adding to the emulsion a sodium chloride solution containing any of the present four-coordinate complexes, each doped emulsion in Example 2 was made via steps of preparing a silver salt solution, a halide solution and a solution containing any of the present four-coordinate complexes separately and then mixing these solutions. This way of doping can ensure an environment to avoid causing the coordination of additional two halogen ions in each complex through interaction between halogen ions and complex molecules before the addition to the emulsion.

In Table 2 are shown the results of doping silver halide emulsion grains by containing therein the complexes in the same doping amount (dopant concentration) as in the cases of obtaining the results shown in Table 1. It can be seen from Table 2 that certain dopants brought emulsions an increase in sensitivity even when the spectral sensitizing dye was absent therein. In the spectral sensitizing dye-added samples, the samples comprising the Co(II) complex-doped emulsions showed a greater increase in sensitivity than the spectral sensitizing dye-free samples when exposed to light of wavelengths corresponding to the intrinsic absorption of silver halide, and thereby these dopants have proved to decrease the intrinsic desensitization. When exposed to light of wavelengths corresponding to the absorption by the spectral sensitizing dye, every sample had a great rise in sensitivity, and the $[CoCl_2(2\text{-}MeIm)_2]^0$-doped emulsion was found to show the greatest rise in sensitivity. On the other hand, the complex having thiazole molecules as ligands which is disclosed to be effective in U.S. Pat. No. 5,360,712 was examined for comparison. In order to avoid the influences of doping effects arising from factors other than ligands upon photographic characteristics, $[CoCl_2(thia)_2]^0$ was chosen as the complex having the same form as the present ones, except for ligands, and served for comparison. On comparison of the doped emulsions, it is noted that the preventive function of the present CO(II) complexes in decreasing the intrinsic desensitization was observed when the doped samples were exposed to light of wavelengths corresponding to the intrinsic absorption of silver halide, but such a preventive function was not observed in the $[CoCl_2(thia)_2]^0$-doped emulsion, and the sensitivity of the $[CoCl_2(thia)_2]^0$-doped emulsion when exposed to light of wavelengths corresponding to the absorption by the spectral sensitizing dye didn't even come close to the sensitivities of the emulsions doped with the present Co(II) complexes. Accordingly, it is considered to be essential for achievement of the present object that the dopant has imidazole molecule (s) or the derivative(s) thereof as ligand(s).

The results obtained when the dopant concentration was increased by a factor of 10 are shown in Table 3. In these cases also, the same tendency was observed. However, the percentage of increase in sensitivity was lower in the cases of high dopant concentration with one exception. Specifically, the Ni complex had a greater effect upon increase in sensitivity when added in the high concentration.

EXAMPLE 3

[Emulsion 19: Emulsion Comprising Cubic Silver Chloride Grains]

Emulsion 19 was prepared in the same manner as Emulsion 1.

[Emulsions 20 to 23 (According to the Present Invention): Emulsions (4) Comprising $[CoCl_2(2\text{-MeIm})_2]^0$-doped Cubic Silver Chloride Grains]

Emulsion 20 was prepared in the same manner as Emulsion 2.

Emulsions 21 to 23 were prepared in the same manner as Emulsion 8, except that the solvents used for Solution 5 were water, methanol and ethanol respectively.

[Emulsions 24 to 26 (According to the Present Invention): Emulsions (5) Comprising $[CoCl_2(2\text{-proIm})_2]^0$-doped Cubic Silver Chloride Grains]

Emulsions 24 to 26 were prepared in the same manner as Emulsion 9, except that the solvents used for Solution 5 were water, methanol and ethanol respectively.

These emulsions were each coated on a triacetyl cellulose film support in the same manner as employed in Example 1 for preparing each of coated Samples 1 to 5, thereby obtaining coated Samples 55 to 59 and coated Samples 70 to 72 respectively.

On the other hand, the Emulsions 20 to 23 and 24 to 26 made above were each spectrally sensitized with $3.8\times10^{-4}$ mole/mole-Ag of the same Sensitizing Dye (1) as used in Example 1, and coated in the same manner as employed for preparing the coated Samples 6 to 10, thereby obtaining coated Samples 60 to 69 and 70 to 78 respectively.

Similarly to Example 1, these samples were each subjected to exposure for sensitometry (for 10 seconds) via an optical wedge, developed for 5 minutes at 20° C., and further subjected sequentially to usual stop, fixation, washing and drying operations. The samples thus processed were each measured for optical density. The results obtained using Emulsions 55 to 69 respectively are shown in Table 4, and those obtained using Emulsions 70 to 78 respectively are shown in Table 5. In Table 4 are shown the relative sensitivities of the coated Samples 55 to 59 (spectral sensitizing dye-free samples) and the coated Samples 60 to 64 (spectral sensitizing dye-added samples) respectively when exposed to light of wavelengths corresponding to the intrinsic absorption of silver halide and the relative sensitivities of the coated Samples 65 to 69 (spectral sensitizing dye-added samples) respectively when exposed to light of wavelengths corresponding to the absorption by the spectral sensitizing dye. In Table 5 are further shown the relative sensitivities of the coated Samples 70 to 72 (spectral sensitizing dye-free samples) and the coated Samples 73 to 75 (spectral sensitizing dye-added samples) respectively when exposed to light of wavelengths corresponding to the intrinsic absorption of silver halide and the relative sensitivities of the coated Samples 76 to 78 (spectral sensitizing dye-added samples) respectively when exposed to light of wavelengths corresponding to the absorption by the spectral sensitizing dye. Additionally, the results of the coated Samples 55, 60 and 65 are shown together in these Tables as those of samples of conventional type.

TABLE 4

| Sample No.*1 | Emulsion No. | Way of adding dopant | Relative sensitivity*2 |
|---|---|---|---|
| 55 (type) | 19 | — | 100 |
| 56 (invention) | 20 | present together with $Cl^-$ | 100 |
| 57 (invention) | 21 | water solution | 101 |
| 58 (invention) | 22 | methanol solution | 101 |
| 59 (invention) | 23 | ethanol solution | 100 |
| 60 (type) | 19 | — | 100 |
| 61 (invention) | 20 | present together with $Cl^-$ | 99 |
| 62 (invention) | 21 | water solution | 103 |
| 63 (invention) | 22 | methanol solution | 108 |
| 64 (invention) | 23 | ethanol solution | 105 |
| 65 (type) | 19 | — | 100 |
| 66 (invention) | 20 | present together with $Cl^-$ | 87 |
| 67 (invention) | 21 | water solution | 127 |
| 68 (invention) | 22 | methanol solution | 137 |
| 69 (invention) | 23 | ethanol solution | 125 |

*1Sample Nos. 55 to 59 were sensitizing dye-free samples, while Sample Nos. 60 to 69 were sensitizing dye-added samples. Sample Nos. 55 to 64 were subjected to blue exposure, while Sample Nos. 65 to 69 were subjected to minus blue exposure.

*2The sensitivities of Sample Nos. 56 to 59 are shown as relative values, with Sample No. 55 being taken as 100; the sensitivities of Sample Nos. 61 to 64 are shown as relative values, with Sample No. 60 being taken as 100; and the sensitivities of Sample Nos. 66 to 69 are shown as relative values, with Sample No. 65 being taken as 100.

TABLE 5

| Sample No.*1 | Emulsion No. | Way of adding dopant | Relative sensitivity*2 |
|---|---|---|---|
| 55 (type) | 19 | — | 100 |
| 70 (invention) | 24 | water solution | 98 |
| 71 (invention) | 25 | methanol solution | 102 |
| 72 (invention) | 26 | ethanol solution | 97 |
| 60 (type) | 19 | — | 100 |
| 73 (invention) | 24 | water solution | 98 |
| 74 (invention) | 25 | methanol solution | 103 |
| 75 (invention) | 26 | ethanol solution | 96 |
| 65 (type) | 19 | — | 100 |
| 76 (invention) | 24 | water solution | 112 |
| 77 (invention) | 25 | methanol solution | 125 |
| 78 (invention) | 26 | ethanol solution | 107 |

*1Sample Nos. 55 and 70 to 72 were sensitizing dye-free samples, while Sample Nos. 60, 65 and 73 to 78 were sensitizing dye-added samples. Sample Nos. 55, 60 and 70 to 75 were subjected to blue exposure, while Sample Nos. 65 and 76 to 78 were subjected to minus blue exposure.

*2The sensitivities of Sample Nos. 70 to 72 are shown as relative values, with Sample No. 55 being taken as 100; the sensitivities of Sample Nos. 73 to 75 are shown as relative values, with Sample No. 60 being taken as 100; and the sensitivities of Sample Nos. 76 to 78 are shown as relative values, with Sample No. 65 being taken as 100.

In a case where an emulsion is made using a solution in which both $Cl^-$ ions and a four-coordinate complex used for doping are incorporated in advance, similarly to Example 1, it is supposed that, in adding it to a reaction vessel, the complex has a six-coordinate octahedral structure through the interaction with additional two $Cl^-$ ions. On the other hand, in a case where an emulsion is made adding a four-coordinate complex for doping as a solution separate from solutions containing silver ions and halogen ions respectively similarly to Example 2, it is supposed that there is only weak interaction between the complex and solvent molecules, and so the complex is added to a reaction vessel as it keeps its original structure. Actually, a clear difference in sensitivity of emulsions made were detected between these two cases where the complex was in different conditions at the time of addition. In this example, therefore, with the intention of investigating changes in photographic characteristics caused by a distinction between two different ways for addition of a dopant, emulsions were prepared using not only a double jet method under the condition that $Cl^-$ ions and a complex for doping are present together but also a triple jet method under the conditions that water, methanol and ethanol were used respectively as solvents for the complex at the time when the complex was added, and examined for their photographic sensitivities. In Table 4 are shown examination results of the $[CoCl_2(2\text{-MeIm})_2]^0$-doped emulsions. A reason why this complex was selected was in that, as Examples 1 and 2 have proved, $[CoCl_2(2\text{-MeIm})_2]^0$ caused the greatest change in sensitivity. Of the emulsions prepared by those methods, the emulsion prepared under a condition that the triple jet method was used and a spectral sensitizing dye was added had a clearly increased sensitivity. In particular, the rise of sensitivity was remarkable when the light of wavelengths at which the spectral sensitizing dye showed absorption was used for exposure, and the highest sensitivity was obtained when methanol was used as the solvent. The tendency similar to the above was observed in the $[CoCl_2(2\text{-proIm})_2]^0$-doped emulsions also. In conclusion, therefore, it is desirable that the doped-emulsions be prepared using a dopant dissolved in methanol in accordance with a triple jet method. Since the sensitivity was lowered when the grain formation was carried out in the presence of both CO(II) complex and $Cl^-$ ions, it can be thought that, as far as a Co(II) complex has a six-coordinate octahedral structure such as $[CoCl_4(2\text{-MeIm})_2]^0$ or a like structure, the incorporation of the complex in silver halide grains is undesirable from the view point of photographic sensitivity. With respect to the emulsions prepared using a triple jet method, although the possibility of incorporating the complex accompanied by solvent molecules into silver chloride grains can be imagined, it is hard to consider in view of weak interaction between complex and solvent molecules that the complex accompanied by solvent molecules is incorporated into silver halide grains as it is. However, it is supposed that the distance between CO(II) ion and the third or fourth $Cl^-$ interacting therewith when $[CoCl_2(2\text{-MeIm})_2]^0$ is incorporated into silver halide grains is different from the distance between CO(II) and $Cl^-$ ions when in the six-coordinate octahedral structure like $[CoCl_4(2\text{-MeIm})_2]^0$ the CO(II) complex has at the time of incorporation into silver halide grains, and this difference is surmised to exert an influence upon photographic characteristics.

EXAMPLE 4

[Emulsions 27 to 33 (According to the Present Invention): Emulsion Comprising Cubic Silver Chloride Grains on the Surface of Which Square Planar Complex of Formula (I) is Localized in Different Amount]

A cubic silver chloride emulsion was prepared in the same manner as Emulsion 1. To separate portions of this emulsion, $[CoCl_2(2\text{-MeIm})_2]^0$ was added in different amounts ranging from $1\times10^{-7}$ to $1\times10^{-4}$ mole/mole-Ag, respectively, and adsorbed to the grain surface by heating to 60° C. The emulsions obtained were referred to as Emulsions 27 to 33.

These emulsions were each coated in the same manner as employed in Example 1 for preparing each of coated Samples 1 to 5, thereby obtaining coated Samples 79 to 85 respectively.

On the other hand, the emulsions made above were each spectrally sensitized with $3.8\times10^{-4}$ mole/mole-Ag of the same Sensitizing Dye (1) as used in Example 1, and coated in the same manner as employed for preparing the coated Samples 6 to 10, thereby obtaining coated Samples 86 to 99 respectively.

Emulsions 27 to 33 were each admixed with $1.8\times10^{-2}$ mole/mole-Ag of 4-hydroxy-6-methyl-1,3,3a-7-tetrazaindene first, and then with $2.5\times10^{-6}$ mole/mole-Ag of sodium thiosulfate. And the resulting emulsions underwent optimal chemical sensitization at 60° C. The emulsions thus obtained were referred to as Emulsions 34 to 40 respectively. Further, these chemically sensitized emulsions each were spectrally sensitized by the addition of $3.8\times10^{-4}$ mole/mole-Ag of the foregoing Sensitizing Dye (1).

After admixed with gelatin and sodium dodecylbenzenesulfonate, each of these chemically sensitized emulsions was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 100 to 106 were prepared.

The chemically and spectrally sensitized emulsions also were coated in the same manner as employed for preparing the foregoing Samples 100 to 106, thereby preparing coated Samples 107 to 120.

In accordance with the same method as in Example 1, these coated Samples were each subjected sequentially to the exposure for sensitometry (10 seconds) via an optical wedge, 5-minute development at 20° C., stop, fixation, washing and drying operations. The samples thus processed were measured for optical density. The examination results obtained are shown in Table 6. More specifically, in Table 6 are shown the relative sensitivities of the coated Samples 79 to 85 (spectral sensitizing dye-free samples) and the coated Samples 100 to 106 (spectral sensitizing dye-free chemically sensitized samples) respectively when exposed to light of wavelengths corresponding to the intrinsic absorption of silver halide, and the relative sensitivities of the coated Samples 86 to 92 (spectral sensitizing dye-added samples) and the coated Samples 107 to 113 (spectral sensitizing dye-added chemically sensitized samples) respectively when exposed to light of wavelengths corresponding to the intrinsic absorption of silver halide. Further, the relative sensitivities of the coated Samples 86 to 92 and the coated Samples 107 to 113 respectively when exposed to light of wavelengths corresponding to the absorption by the spectral sensitizing dye are shown in Table 6 (represented by Samples 93 to 99 and Samples 114 to 120, respectively).

TABLE 6

| Amount | No chemical sensitization | | | Chemical sensitization | | |
|---|---|---|---|---|---|---|
| added (mol/mol Ag) | Sample No.*1 | Emulsion No. | Relative sensitivity*2 | Sample No.*1 | Emulsion No. | Relative sensitivity*2 |
| not added | 79 (type) | 27 | 100 | 100 (type) | 34 | 100 |
| $1\times10^{-7}$ | 80 (invention) | 28 | 98 | 101 (invention) | 35 | 100 |

TABLE 6-continued

| Amount added (mol/mol Ag) | No chemical sensitization | | | Chemical sensitization | | |
|---|---|---|---|---|---|---|
| | Sample No.*1 | Emulsion No. | Relative sensitivity*2 | Sample No.*1 | Emulsion No. | Relative sensitivity*2 |
| $5 \times 10^{-7}$ | 81 (invention) | 29 | 97 | 102 (invention) | 36 | 100 |
| $1 \times 10^{-6}$ | 82 (invention) | 30 | 97 | 103 (invention) | 37 | 100 |
| $5 \times 10^{-6}$ | 83 (invention) | 31 | 96 | 104 (invention) | 38 | 99 |
| $1 \times 10^{-5}$ | 84 (invention) | 32 | 97 | 105 (invention) | 39 | 99 |
| $1 \times 10^{-4}$ | 85 (invention) | 33 | 97 | 106 (invention) | 40 | 99 |
| not added | 86 (type) | 27 | 100 | 107 (type) | 34 | 100 |
| $1 \times 10^{-7}$ | 87 (invention) | 28 | 96 | 108 (invention) | 35 | 100 |
| $5 \times 10^{-7}$ | 88 (invention) | 29 | 95 | 109 (invention) | 36 | 101 |
| $1 \times 10^{-6}$ | 89 (invention) | 30 | 95 | 100 (invention) | 37 | 102 |
| $5 \times 10^{-6}$ | 90 (invention) | 31 | 94 | 111 (invention) | 38 | 100 |
| $1 \times 10^{-5}$ | 91 (invention) | 32 | 95 | 112 (invention) | 39 | 100 |
| $1 \times 10^{-4}$ | 92 (invention) | 33 | 96 | 113 (invention) | 40 | 100 |
| not added | 93 (type) | 27 | 100 | 114 (type) | 34 | 100 |
| $1 \times 10^{-7}$ | 94 (invention) | 28 | 91 | 115 (invention) | 35 | 102 |
| $5 \times 10^{-7}$ | 95 (invention) | 29 | 81 | 116 (invention) | 36 | 104 |
| $1 \times 10^{-6}$ | 96 (invention) | 30 | 79 | 117 (invention) | 37 | 104 |
| $5 \times 10^{-6}$ | 97 (invention) | 31 | 77 | 118 (invention) | 38 | 105 |
| $1 \times 10^{-5}$ | 98 (invention) | 32 | 78 | 119 (invention) | 39 | 104 |
| $1 \times 10^{-4}$ | 99 (invention) | 33 | 80 | 120 (invention) | 40 | 103 |

*1Sample Nos. 79 to 85 and 100 to 106 were sensitizing dye-free samples, while Sample Nos. 86 to 99 and 107 to 120 were sensitizing dye-added samples. Sample Nos. 79 to 92 and 100 to 113 were subjected to blue exposure, while Sample Nos. 93 to 99 and 114 to 120 were subjected to minus blue exposure.

*2The sensitivities of Sample Nos. 80 to 85 are shown as relative values, with Sample No. 79 being taken as 100; the sensitivities of Sample Nos. 87 to 92 are shown as relative values, with Sample No. 86 being taken as 100; the sensitivities of Sample Nos. 94 to 99 are shown as relative values, with Sample No. 93 being taken as 100; the sensitivities of Sample Nos. 101 to 106 are shown as relative values, with Sample No. 100 being taken as 100;the sensitivities of Sample Nos. 108 to 113 are shown as relative values, with Sample No. 107 being taken as 100; and the sensitivities of Sample Nos. 115 to 120 are shown as relative values, with Sample No. 114 being taken as 100.

Upon a consideration of the possibility that the present complexes have influence upon photographic characteristics by their localization in the vicinity of the grain surface, but not doping the interior of grains, the emulsion grains to the surface of which $[CoCl_2(2\text{-MeIm})_2]^0$ was adsorbed intentionally were examined for photographic characteristics. With respect to the samples shown in Table 6, it can be seen that, though the chemically sensitized samples showed an increase in sensitivity when exposed to light of wavelengths corresponding to the absorption by the spectral sensitizing dye, the emulsions subjected to no chemical sensitization underwent clear desensitization. Although the detailed origins of such a distinction are unknown, these photographic characteristics are clearly different from those of the present four-coordinate complex-doped emulsions in Examples 1 to 3.

EXAMPLE 5

[Emulsion 41: Preparation of Cubic Silver Bromide Emulsion]

To 870 ml of water were added 36 g of deionized gelatin and 0.25 g of potassium bromide to prepare a solution. To this gelatin solution kept at 50° C. with stirring, 36 ml of a 0.088 M aqueous solution of silver nitrate (Solution 6) and 36 ml of a 0.088 M aqueous solution of potassium bromide (Solution 7) were added at a constant flow rate over a 10-minute period in accordance with a double jet method. Subsequently thereto, 176 ml of Solution 6 and 176 ml of Solution 7 were added over a 7-minute period using the double jet method. Thereafter, 898 ml of a 0.82 M aqueous solution of silver nitrate (Solution 8) was further added over a 95-minute period at an accelerated flow rate, beginning with the flow rate of 0.53 ml/min, and simultaneously therewith a 0.90 M aqueous solution of potassium bromide (Solution 9) was added while controlling so that the potential of the reaction mixture was kept at Ag potential+120 mV (with reference to the saturated calomel electrode). After the 5 minute-lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and phenol, and adjusted to pH 6.5. The emulsion grains formed in the foregoing manner were monodispersed silver bromide cubes having an edge length of 0.5 $\mu$m.

[Emulsions 42 to 45 (According to the Present Invention): Present CO(II) COmplex-doped Cubic Silver Bromide Emulsions]

Emulsions 42 to 45 were prepared in the same manner as Emulsion 41, except that ether of the present CO(II) complexes shown in Table 7 was contained in Solution 9 in concentrations of $8.2\times10^{-7}$ M (Emulsion 42 and 44) and $8.2\times10^{-6}$ M (Emulsions 43 and 45).

After admixed with gelatin and sodium dodecylbenzenesulfonate, each of these Emulsions 41 to 45 was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 121 to 125 were prepared. Further, each of those Emulsions 41 to 45 was spectrally sensitized by adding thereto $4.9\times10^{-4}$ mole/mole-Ag of the same sensitizing dye (1) as in Example 1, and coated in the same manner as mentioned above to prepare each of coated Samples 126 to 135.

The foregoing silver bromide Emulsions 41 to 45 were each admixed with $1.2\times10^{-4}$ mole/mole-Ag of sodium thiosulfate, and underwent optimal chemical sensitization at 60° C. These chemically sensitized emulsions were each coated in the same manner as employed for the coated Samples 121 to 125, thereby providing coated Samples 136 to 140 respectively. Further, these chemically sensitized emulsions each were spectrally sensitized by the addition of $4.9\times10^{-4}$ mole/mole-Ag of the same Sensitizing Dye (1) as used in Example 1, and coated in the same manner as employed for the coated Samples 121 to 125, thereby providing coated Samples 141 to 150 respectively.

These Samples were each subjected to the exposure for sensitometry (1 second) via an optical wedge, and then developed for 10 minutes at 20° C. with Developer 2 prepared according to the formulation described below. Thereafter, each sample underwent sequentially stop, fixation, washing and drying operations, and then were measured for optical density. The fog density was determined as the minimum optical density of each sample, and the sensitivity was represented by the logarithm of an exposure amount required for providing the optical density of fog+0.1. The sensitivities of Samples are shown as relative values in Table 7, with the dopant-free Sample (which is a conventional type, and so referred to as "type") being taken as 100. With respect to the coated Samples 121 to 125 (spectral sensitizing dye-free samples) and the coated Samples 126 to 130 (spectral sensitizing dye-added samples), the sensitivity of each sample shown in Table 7 is relative sensitivity determined when the sample was exposed to light of wavelengths at which the silver halide therein had the intrinsic absorption. And the sensitivities of coated Samples 131 to 135 (spectral sensitizing dye-added samples) shown in Table 7 are relative sensitivities determined when the samples were exposed to light of wavelengths at which the spectral sensitizing dye had the absorption. Further, in Table 8 are shown the relative sensitivities of the coated Samples 136 to 140 (chemically sensitized, spectral sensitizing dye-free samples) and the coated Samples 141 to 145 (chemically sensitized, spectral sensitizing dye-added samples) respectively when exposed to light of wavelengths corresponding to the intrinsic absorption of silver halide and the relative sensitivities of the coated Samples 146 to 150 (chemically sensitized, spectral sensitizing dye-added samples) respectively when exposed to light of wavelengths corresponding to the absorption by the spectral sensitizing dye. Additionally, the coated Samples 126 to 130 were the same as the coated Samples 131 to 135 respectively, and the coated Samples 141 to 145 were the same as the coated Samples 146 to 150 respectively. However, the samples corresponding to each other were different in wavelengths of exposure light used for sensitometry although the same emulsion was used therein. Therefore, two different numbers were given to the same sample.

| Developer 2 | |
|---|---|
| Metol | 2.5 g |
| L-Ascorbic acid | 10.0 g |
| Nabox | 35.0 g |
| KBr | 1.0 g |
| Water to make | 1 liter |
| pH adjusted to | 9.6 |

TABLE 7

| Sample No.*1 | Emulsion No. | Dopant | Relative Sensitivity*2 |
|---|---|---|---|
| 121 (type) | 41 | absent | 100 |
| 122 (invention) | 42 | $[CoCl_2(2\text{-MeIm})_2]^a$ | 100 |
| 123 (invention) | 43 | $[CoCl_2(2\text{-MeIm})_2]^b$ | 99 |
| 124 (invention) | 44 | $[CoCl_2(2\text{-proIm})_2]^a$ | 100 |
| 125 (invention) | 45 | $[CoCl_2(2\text{-proIm})_2]^b$ | 99 |
| 126 (type) | 41 | absent | 100 |
| 127 (invention) | 42 | $[CoCl_2(2\text{-MeIm})_2]^a$ | 108 |
| 128 (invention) | 43 | $[CoCl_2(2\text{-MeIm})_2]^b$ | 110 |
| 129 (invention) | 44 | $[CoCl_2(2\text{-proIm})_2]^a$ | 110 |
| 130 (invention) | 45 | $[CoCl_2(2\text{-proIm})_2]^b$ | 109 |
| 131 (type) | 41 | absent | 100 |
| 132 (invention) | 42 | $[CoCl_2(2\text{-MeIm})_2]^a$ | 106 |
| 133 (invention) | 43 | $[CoCl_2(2\text{-MeIm})_2]^b$ | 107 |
| 134 (invention) | 44 | $[CoCl_2(2\text{-proIm})_2]^a$ | 107 |
| 135 (invention) | 45 | $[CoCl_2(2\text{-proIm})_2]^b$ | 108 |

[a]Dopant concentration ($1\times10^{-6}$ mol/mol-Ag)
[b]Dopant concentration ($1\times10^{-5}$ mol/mol-Ag)
*1Sample Nos. 121 to 125 were sensitizing dye-free samples and Sample Nos. 126 to 135 were sensitizing dye-added samples. Sample Nos. 121 to 130 were subjected to blue exposure, while Sample Nos. 131 to 135 were subjected to minus blue exposure.
*2The sensitivities of Sample Nos. 122 to 125 are shown as relative values, with Sample No. 121 being taken as 100; the sensitivities of Sample Nos. 127 to 130 are shown as relative values, with Sample No. 126 being taken as 100; and the sensitivities of Sample Nos. 132 to 135 are shown as relative values, with Sample No. 131 being taken as 100.

TABLE 8

| Sample No.*1 | Emulsion No. | Dopant | Relative Sensitivity*2 |
|---|---|---|---|
| 136 (type) | 46 | absent | 100 |
| 137 (invention) | 47 | $[CoCl_2(2\text{-MeIm})_2]^a$ | 96 |
| 138 (invention) | 48 | $[CoCl_2(2\text{-MeIm})_2]^b$ | 97 |
| 139 (invention) | 49 | $[CoCl_2(2\text{-proIm})_2]^a$ | 98 |
| 140 (invention) | 50 | $[CoCl_2(2\text{-proIm})_2]^b$ | 96 |
| 141 (type) | 46 | absent | 100 |
| 142 (invention) | 47 | $[CoCl_2(2\text{-MeIm})_2]^a$ | 107 |
| 143 (invention) | 48 | $[CoCl_2(2\text{-MeIm})_2]^b$ | 105 |

TABLE 8-continued

| Sample No.*1 | Emulsion No. | Dopant | Relative Sensitivity*2 |
|---|---|---|---|
| 144 (invention) | 49 | $[CoCl_2(2\text{-proIm})_2]^a$ | 112 |
| 145 (invention) | 50 | $[CoCl_2(2\text{-proIm})_2]^b$ | 105 |
| 146 (type) | 46 | absent | 100 |
| 147 (invention) | 47 | $[CoCl_2(2\text{-MeIm})_2]^a$ | 109 |
| 148 (invention) | 48 | $[CoCl_2(2\text{-MeIm})_2]^b$ | 107 |
| 149 (invention) | 49 | $[CoCl_2(2\text{-proIm})_2]^a$ | 110 |
| 150 (invention) | 50 | $[CoCl_2(2\text{-proIm})_2]^b$ | 107 |

[a]Dopant concentration ($1 \times 10^{-6}$ mol/mol-Ag)
[b]Dopant concentration ($1 \times 10^{-5}$ mol/mol-Ag)
*1Sample Nos. 136 to 140 were sensitizing dye-free samples and Sample Nos. 141 to 150 were sensitizing dye-added samples. Sample Nos. 136 to 145 were subjected to blue exposure, while Sample Nos. 146 to 150 were subjected to minus blue exposure.
*2The sensitivities of Sample Nos. 137 to 140 are shown as relative values, with Sample No. 136 being taken as 100; the sensitivities of Sample Nos. 142 to 145 are shown as relative values, with Sample No. 141 being taken as 100; and the sensitivities of Sample Nos. 147 to 150 are shown as relative values, with Sample No. 146 being taken as 100.

With respect to the samples shown in Table 7 which was not subjected to chemical sensitization, in analogy with the case of silver chloride, the samples in which the spectral sensitizing dye was absent caused no appreciable change in photographic characteristic due to the doping, while a rise in sensitivity by the doping was observed in the samples in which the spectral sensitizing dye was present, irrespective of the wavelength of exposure light. Therein, however, an appreciable difference due to the change in dopant concentration was not detected in photographic characteristic when chemical sensitization was not carried out. In the case where chemical sensitization was carried out, on the other hand, a rise in sensitivity was observed in the spectral sensitizing dye-added samples, and the extent of rise in sensitivity was greater in the samples having the lower dopant concentration.

EXAMPLE 6

[Emulsion 51: Preparation of Cubic Silver Bromide Emulsion]

Emulsion 51 was prepared in the same manner as Emulsion 41 obtained in Example 5.

[Emulsions 52 to 57 (According to the Present Invention): Cubic Silver Bromide Emulsions Doped with Present Cu(II) Complexes of Formula (I) Respectively]

In the same manner as Emulsions 42 to 45 obtained in Example 5, except that the two different Cu(II) complexes were each added to Solution 9 in concentrations of $8.2\times10^{-8}$ M, $8.2\times10^{-7}$ M and 8.2 to $10^{-6}$ M respectively, groups of Emulsions 52 to 54 and Emulsions 55 to 57 were prepared. The amounts of each complex added therein were $1\times10^{-7}$ mole, $1\times10^{-6}$ mole and 1×10–5 mole, per mol of Ag respectively.

Each of these Emulsions 51 to 57 was coated in the same manner as mentioned in Example 5 to provide coated Samples 151 to 157. On the other hand, each of those Emulsions 51 to 67 was further spectrally sensitized by adding thereto $4.9\times10^{-4}$ mole/mole-Ag of the same sensitizing dye (1) as in Example 1, and coated in the same manner as mentioned in Example 5 to prepare each of coated Samples 158 to 171.

The foregoing Emulsions 51 to 57 were each chemically sensitized in the same way as in Example 5, and coated in the same manner as employed for the coated Samples 151 to 157, thereby providing coated Samples 172 to 178 respectively. Further, these chemically sensitized emulsions were each spectrally sensitized by the addition of $4.9\times10^{-4}$ mole/mole-Ag of the same Sensitizing Dye (1) as in Example 1, and coated in the same manner as mentioned above, thereby providing coated Samples 180 to 192 respectively.

Each of these Samples was subjected to two different exposure operations (i.e., 1 second and $10^{-3}$ second) respectively for sensitometry via an optical wedge, and then developed by the same method as adopted in Example 5. Thereafter, each sample underwent sequentially usual stop, fixation, washing and drying operations, and then measured for optical density. With respect to the coated Samples 151 to 157 (spectral sensitizing dye-free samples) and the coated Samples 158 to 164 (spectral sensitizing dye-added samples), the sensitivity of each sample shown in Table 9 is relative sensitivity determined when the sample was exposed to light of wavelengths at which the silver halide therein had the intrinsic absorption. And the sensitivities of coated Samples 165 to 171 (spectral sensitizing dye-added samples) shown in Table 9 are relative sensitivities determined when the samples were exposed to light of wavelengths at which the spectral sensitizing dye had the absorption. Further, in Table 10 are shown the relative sensitivities of the coated Samples 172 to 178 (chemically sensitized, spectral sensitizing dye-free samples) and the coated Samples 179 to 185 (chemically sensitized, spectral sensitizing dye-added samples) respectively when exposed to light of wavelengths corresponding to the intrinsic absorption of silver halide and the relative sensitivities of the coated Samples 186 to 192 (chemically sensitized, spectral sensitizing dye-added samples) respectively when exposed to light of wavelengths corresponding to the absorption by the spectral sensitizing dye.

TABLE 9

| Sample No.*1 | Emulsion No. | Dopant | Amount added (mol/mol Ag) | Relative Sensitivity*2 One-second exposure | Relative Sensitivity*2 $10^{-3}$-second exposure |
|---|---|---|---|---|---|
| 151 (type) | 51 | not added | — | 100 | 100 |
| 152 (invention) | 52 | $[CuCl_2(2\text{-MeIm})_2]$ | $1 \times 10^{-7}$ | 101 | 100 |
| 153 (invention) | 53 | $[CuCl_2(2\text{-MeIm})_2]$ | $1 \times 10^{-6}$ | 101 | 100 |
| 154 (invention) | 54 | $[CuCl_2(2\text{-MeIm})_2]$ | $1 \times 10^{-5}$ | 100 | 100 |
| 155 (invention) | 55 | $[CuCl_2(2\text{-proIm})_2]$ | $1 \times 10^{-7}$ | 117 | 112 |
| 156 (invention) | 56 | $[CuCl_2(2\text{-proIm})_2]$ | $1 \times 10^{-6}$ | 105 | 107 |
| 157 (invention) | 57 | $[CuCl_2(2\text{-proIm})_2]$ | $1 \times 10^{-5}$ | 98 | 100 |
| 158 (type) | 51 | not added | — | 100 | 100 |
| 159 (invention) | 52 | $[CuCl_2(2\text{-MeIm})_2]$ | $1 \times 10^{-7}$ | 107 | 101 |

TABLE 9-continued

| Sample No.*1 | Emulsion No. | Dopant | Amount added (mol/mol Ag) | Relative Sensitivity*2 One-second exposure | Relative Sensitivity*2 $10^{-3}$-second exposure |
|---|---|---|---|---|---|
| 160 (invention) | 53 | $[CuCl_2(2\text{-MeIm})_2]$ | $1 \times 10^{-6}$ | 106 | 103 |
| 161 (invention) | 54 | $[CuCl_2(2\text{-MeIm})_2]$ | $1 \times 10^{-5}$ | 104 | 101 |
| 162 (invention) | 55 | $[CuCl_2(2\text{-proIm})_2]$ | $1 \times 10^{-7}$ | 113 | 111 |
| 163 (invention) | 56 | $[CuCl_2(2\text{-proIm})_2]$ | $1 \times 10^{-6}$ | 108 | 109 |
| 164 (invention) | 57 | $[CuCl_2(2\text{-proIm})_2]$ | $1 \times 10^{-5}$ | 107 | 102 |
| 165 (type) | 51 | not added | — | 100 | 100 |
| 166 (invention) | 52 | $[CuCl_2(2\text{-MeIm})_2]$ | $1 \times 10^{-7}$ | 103 | 100 |
| 167 (invention) | 53 | $[CuCl_2(2\text{-MeIm})_2]$ | $1 \times 10^{-6}$ | 105 | 102 |
| 168 (invention) | 54 | $[CuCl_2(2\text{-MeIm})_2]$ | $1 \times 10^{-5}$ | 110 | 101 |
| 169 (invention) | 55 | $[CuCl_2(2\text{-proIm})_2]$ | $1 \times 10^{-7}$ | 106 | 107 |
| 170 (invention) | 56 | $[CuCl_2(2\text{-proIm})_2]$ | $1 \times 10^{-6}$ | 105 | 112 |
| 171 (invention) | 57 | $[CuCl_2(2\text{-proIm})_2]$ | $1 \times 10^{-5}$ | 103 | 102 |

*1Sample Nos. 151 to 157 were sensitizing dye-free samples and Sample Nos. 158 to 171 were sensitizing dye-added samples. Sample Nos. 151 to 164 were subjected to blue exposure, while Sample Nos. 165 to 171 were subjected to minus blue exposure.
*2The sensitivities of Sample Nos. 152 to 157 are shown as relative values, with Sample No. 151 being taken as 100; the sensitivities of Sample Nos. 159 to 164 are shown as relative values, with Sample No. 158 being taken as 100; and the sensitivities of Sample Nos. 166 to 171 are shown as relative values, with Sample No. 165 being taken as 100.

TABLE 10

| Sample No.*1 | Emulsion No. | Dopant | Amount added (mol/mol Ag) | Relative Sensitivity*2 One-second exposure | Relative Sensitivity*2 $10^{-3}$-second exposure |
|---|---|---|---|---|---|
| 172 (type) | 58 | not added | — | 100 | 100 |
| 173 (invention) | 59 | $[CuCl_2(2\text{-MeIm})_2]$ | $1 \times 10^{-7}$ | 98 | 100 |
| 174 (invention) | 60 | $[CuCl_2(2\text{-MeIm})_2]$ | $1 \times 10^{-6}$ | 96 | 100 |
| 175 (invention) | 61 | $[CuCl_2(2\text{-MeIm})_2]$ | $1 \times 10^{-5}$ | 96 | 98 |
| 176 (invention) | 62 | $[CuCl_2(2\text{-proIm})_2]$ | $1 \times 10^{-7}$ | 119 | 117 |
| 177 (invention) | 63 | $[CuCl_2(2\text{-proIm})_2]$ | $1 \times 10^{-6}$ | 105 | 104 |
| 178 (invention) | 64 | $[CuCl_2(2\text{-proIm})_2]$ | $1 \times 10^{-5}$ | 102 | 102 |
| 179 (type) | 58 | not added | — | 100 | 100 |
| 180 (invention) | 59 | $[CuCl_2(2\text{-MeIm})_2]$ | $1 \times 10^{-7}$ | 105 | 110 |
| 181 (invention) | 60 | $[CuCl_2(2\text{-MeIm})_2]$ | $1 \times 10^{-6}$ | 112 | 107 |
| 182 (invention) | 61 | $[CuCl_2(2\text{-MeIm})_2]$ | $1 \times 10^{-5}$ | 107 | 104 |
| 183 (invention) | 62 | $[CuCl_2(2\text{-proIm})_2]$ | $1 \times 10^{-7}$ | 129 | 119 |
| 184 (invention) | 63 | $[CuCl_2(2\text{-proIm})_2]$ | $1 \times 10^{-6}$ | 113 | 109 |
| 185 (invention) | 64 | $[CuCl_2(2\text{-proIm})_2]$ | $1 \times 10^{-5}$ | 110 | 104 |
| 186 (type) | 58 | not added | — | 100 | 100 |
| 187 (invention) | 59 | $[CuCl_2(2\text{-MeIm})_2]$ | $1 \times 10^{-7}$ | 103 | 100 |
| 188 (invention) | 60 | $[CuCl_2(2\text{-MeIm})_2]$ | $1 \times 10^{-6}$ | 106 | 105 |
| 189 (invention) | 61 | $[CuCl_2(2\text{-MeIm})_2]$ | $1 \times 10^{-5}$ | 102 | 103 |
| 190 (invention) | 62 | $[CuCl_2(2\text{-proIm})_2]$ | $1 \times 10^{-7}$ | 118 | 119 |
| 191 (invention) | 63 | $[CuCl_2(2\text{-proIm})_2]$ | $1 \times 10^{-6}$ | 109 | 108 |
| 192 (invention) | 64 | $[CuCl_2(2\text{-proIm})_2]$ | $1 \times 10^{-5}$ | 105 | 104 |

*1Sample Nos. 172 to 178 were sensitizing dye-free samples and Sample Nos. 180 to 192 were sensitizing dye-added samples. Sample Nos. 172 to 185 were subjected to blue exposure, while Sample Nos. 186 to 192 were subjected to minus blue exposure.
*2The sensitivities of Sample Nos. 173 to 178 are shown as relative values, with Sample No. 172 being taken as 100; the sensitivities of Sample Nos. 180 to 185 are shown as relative values, with Sample No. 179 being taken as 100; and the sensitivities of Sample Nos. 187 to 192 are shown as relative values, with Sample No. 186 being taken as 100.

It can be seen from Tables 9 and 10 that the $[CuCl_2(2\text{-MeIm})_2]^0$-doped emulsions exhibited the photographic characteristics highly similar to those of the Co(II) complex-doped emulsions prepared in Example 5 whether or not they underwent chemical sensitization, and whether or not the spectral sensitizing dye was present therein. On the other hand, the $[CuCl_2(2\text{-proIm})_2]^0$-doped emulsions had a remarkable rise in their sensitivities, irrespective of chemical sensitization, spectral sensitizing dye and exposure time. In particular, the rise in sensitivity was found to be greatest in cases where the dopant was added in the smallest amount.

EXAMPLE 7

[Emulsion 65: Preparation of Cubic Silver Bromide Emulsion]

Emulsion 65 was prepared in the same manner as Emulsion 41 obtained in Example 5.

[Emulsions 66 to 70 (According to the Present Invention): The Present $[NiCl_2(2\text{-MeIm})_2]^0$ Complex-doped Cubic Silver Bromide Emulsions]

Emulsions 66 to 70 were prepared in the same manner as Emulsions 42 to 45 obtained in Example 5, except that the present $[NiCl_2(2\text{-MeIm})_2]^0$ complex was added to Solution 9 in concentrations of $8.2\times10^{-8}$ M, $4.1\times10^{-7}$ M, $8.2\times10^{-7}$ M, $8.2\times10^{-6}$ M and $8.2\times10^{-5}$ M, respectively. The amounts of complex added therein were $1\times10^{-7}$ mole, $5\times10^{-7}$ mole, $1\times10^{-6}$ mole, $1\times10^{-5}$ mole and $1\times10^{-4}$ mol, per mole of Ag, respectively.

The foregoing Emulsions 65 to 70 were each chemically sensitized and coated in the same manner as in Example 5, thereby providing coated Samples 211 to 216 respectively. Further, these chemically sensitized emulsions each were spectrally sensitized by the addition of $4.9\times10^{-4}$ mole/mole-Ag of the same Sensitizing Dye (1) as in Example 1, and coated in the same manner as mentioned above, thereby providing coated Samples 217 to 228 respectively.

Each of these Samples was subjected to two different exposure operations (i.e., 1 second and $10^{-3}$ second) respectively for sensitometry via an optical wedge, and then developed by the same method as adopted in Example 5. Thereafter, each sample underwent sequentially usual stop, fixation, washing and drying operations, and then measured for optical density. In Table 11 are shown the relative sensitivities of the coated Samples 211 to 216 (chemically sensitized, spectral sensitizing dye-free samples) and the coated Samples 217 to 222 (chemically sensitized, spectral sensitizing dye-added samples) respectively when exposed to light of wavelengths corresponding to the intrinsic absorption of silver halide, and the relative sensitivities of the coated Samples 223 to 228 (chemically sensitized, spectral sensitizing dye-added samples) respectively when exposed to light of wavelengths corresponding to the absorption by the spectral sensitizing dye.

TABLE 11

| Sample No.*1 | Emulsion No. | Amount added (mol/mol Ag) | Relative Sensitivity*2 One-second exposure | Relative Sensitivity*2 $10^{-3}$-second exposure |
|---|---|---|---|---|
| 211 (type) | 71 | not added | 100 | 100 |
| 212 (invention) | 72 | $1\times10^{-7}$ | 100 | 100 |
| 213 (invention) | 73 | $5\times10^{-7}$ | 100 | 100 |
| 214 (invention) | 74 | $1\times10^{-6}$ | 102 | 100 |
| 215 (invention) | 75 | $1\times10^{-5}$ | 97 | 99 |
| 216 (invention) | 76 | $1\times10^{-4}$ | 96 | 98 |
| 217 (type) | 71 | not added | 100 | 100 |
| 218 (invention) | 72 | $1\times10^{-7}$ | 120 | 109 |
| 219 (invention) | 73 | $5\times10^{-7}$ | 119 | 110 |
| 220 (invention) | 74 | $1\times10^{-6}$ | 117 | 108 |
| 221 (invention) | 75 | $1\times10^{-5}$ | 117 | 108 |
| 222 (invention) | 76 | $1\times10^{-4}$ | 115 | 106 |
| 223 (type) | 71 | not added | 100 | 100 |
| 224 (invention) | 72 | $1\times10^{-7}$ | 115 | 107 |
| 225 (invention) | 73 | $5\times10^{-7}$ | 112 | 108 |
| 226 (invention) | 74 | $1\times10^{-6}$ | 111 | 106 |
| 227 (invention) | 75 | $1\times10^{-5}$ | 111 | 107 |
| 228 (invention) | 76 | $1\times10^{-4}$ | 110 | 105 |

*1Sample Nos. 211 to 216 were sensitizing dye-free samples and Sample Nos. 217 to 228 were sensitizing dye-added samples. Sample Nos. 211 to 222 were subjected to blue exposure, while Sample Nos. 223 to 228 were subjected to minus blue exposure.

TABLE 11-continued

| Sample No.*1 | Emulsion No. | Amount added (mol/mol Ag) | Relative Sensitivity*2 One-second exposure | Relative Sensitivity*2 $10^{-3}$-second exposure |
|---|---|---|---|---|

*2The sensitivities of Sample Nos. 212 to 216 are shown as relative values, with Sample No. 211 being taken as 100; the sensitivities of Sample Nos. 218 to 222 are shown as relative values, with Sample No. 217 being taken as 100; and the sensitivities of Sample Nos. 224 to 228 are shown as relative values, with Sample No. 223 being taken as 100.

In analogy with the Co(II)complex-doped emulsions prepared in Example 5, the $[NiCl_2(2\text{-MeIm})_2]^0$-doped emulsions had a rise in their sensitivities when the spectral sensitizing dye was added thereto, irrespective of chemical sensitization. The rise in sensitivity was found to be greatest when the dopant was added in a small amount of about $1\times10^{-7}$ mole/mole-Ag.

EXAMPLE 8

[Emulsion 77: Preparation of Emulsion Comprising Tabular Silver Iodobromide Grains Having (111) Face as Main Plane]

In a reaction vessel was placed 1 liter of a dispersing medium solution containing 0.38 g of KBr and 0.5 g of low molecular weight gelatin (molecular weight: 15,000), and kept at 40° C. To this solution with stirring, 20 ml of a 0.29 M silver nitrate solution and 20 ml of a 0.29 M KBr solution were added over a 40-second period in accordance with a double jet method. After the addition, 15 minutes were spent in heating this dispersing medium solution up to 75° C. After a 15-minute lapse from such a heating operation, a dispersing medium solution containing 35 g of alkali-processed gelatin and 250 ml of water was further added. After adjusting the pH to 6.0, 734 ml of a 1.2 M silver nitrate solution was added at an increasing flow rate. During this addition operation, a mixture of KBr and KI solutions (Solution 10) was added simultaneously so that the pBr was kept at 2.93. Therein, the KI solution and the KBr solution were added in such amounts that the $I^-$ concentration was 3 mole % based on the amount of silver added.

[Emulsions 78 to 80 (According to the Present Invention): Tabular Silver Iodobromide Emulsions Doped with Present Four-coordinate Complexes of Formula (I)]

Emulsions 78 to 80 were prepapred in the same manner as Emulsion 77, except that the Solution 10 contained the present three different four-coordinate complexes respectively in a concentration of $1.2\times10^{-6}$ M.

The foregoing Emulsions 77 to 80 were each admixed with $8.0\times10^{-6}$ mole/mole-Ag of sodium thiosulfate and $3\times10^{-6}$ mole/mole-Ag of chloroauric acid and potassium thiosulfate, and underwent optimal chemical sensitization at 60° C. These chemically sensitized emulsions (Emulsions 81 to 84) were coated in the same manner as in Example 5, thereby providing coated Samples 241 to 244 respectively. Further, those chemically sensitized emulsions each were spectrally sensitized by the addition of $4.9\times10^{-4}$ mole/mole-Ag of the same Sensitizing Dye (1) as in Example 1, and coated in the same manner as employed for prepation of the coated Samples 241 to 244, thereby providing coated Samples 245 to 252 respectively.

Each of these Samples was subjected to two different exposure operations (i.e., 1 second and $10^{-3}$ second) respectively for sensitometry via an optical wedge, and then developed by the same method as adopted in Example 5. Thereafter, each sample underwent sequentially usual stop, fixation, washing and drying operations, and then measured for optical density. In Table 12 are shown the relative sensitivities of the coated Samples 241 to 244 (chemically sensitized, spectral sensitizing dye-free samples) and the coated Samples 245 to 248 (chemically sensitized, spectral sensitizing dye-added samples) respectively when exposed to light of wavelengths corresponding to the intrinsic absorption of silver halide, and the relative sensitivities of the coated Samples 249 to 252 (chemically sensitized, spectral sensitizing dye-added samples) respectively when exposed to light of wavelengths corresponding to the absorption by the spectral sensitizing dye.

TABLE 12

| Sample No.*1 | Emulsion No. | Dopant | Relative Sensitivity*2 One-second exposure | Relative Sensitivity*2 $10^{-3}$-second exposure |
|---|---|---|---|---|
| 241 (type) | 81 | not added | 100 | 100 |
| 242 (invention) | 82 | $[CuCl_2(2\text{-proIm})_2]^0$ | 112 | 107 |
| 243 (invention) | 83 | $[NiCl_2(2\text{-MeIm})_2]^0$ | 109 | 104 |
| 244 (invention) | 84 | $[CoCl_2(2\text{-proIm})_2]^0$ | 102 | 100 |
| 245 (type) | 81 | not added | 100 | 100 |
| 246 (invention) | 82 | $[CuCl_2(2\text{-proIm})_2]^0$ | 125 | 109 |
| 247 (invention) | 83 | $[NiCl_2(2\text{-MeIm})_2]^0$ | 128 | 116 |
| 248 (invention) | 84 | $[CoCl_2(2\text{-proIm})_2]^0$ | 111 | 106 |
| 249 (type) | 81 | not added | 100 | 100 |
| 250 (invention) | 82 | $[CuCl_2(2\text{-proIm})_2]^0$ | 107 | 103 |
| 251 (invention) | 83 | $[NiCl_2(2\text{-MeIm})_2]^0$ | 120 | 110 |
| 252 (invention) | 84 | $[CoCl_2(2\text{-proIm})_2]^0$ | 113 | 104 |

*1Sample Nos. 241 to 244 were sensitizing dye-free samples and Sample Nos. 245 to 252 were sensitizing dye-added samples. Sample Nos. 241 to 248 were subjected to blue exposure, while Sample Nos. 249 to 252 were subjected to minus blue exposure.

*2The sensitivities of Sample Nos. 242 to 244 are shown as relative values, with Sample No. 241 being taken as 100; the sensitivities of Sample Nos. 246 to 248 are shown as relative values, with Sample No. 245 being taken as 100; and the sensitivities of Sample Nos. 250 to 252 are shown as relative values, with Sample No. 249 being taken as 100.

The complexes $[CuCl_2(2\text{-proIm})_2]^0$, $[NiCl_2(2\text{-MeIm})_2]^0$ and $[CoCl_2(2\text{-proIm})_2]^0$, which have proved to be highly effective in increasing the sensitivity of cubic silver bromide emulsions, were each used for doping tabular silver iodobromide emulsions. It can be seen from the data shown in Table 12 that every doped sample had a rise in emulsion's sensitivity. In analogy with cubic emulsions, the dye-added samples had a greater rise in their sensitivities. Of these samples, the chemically sensitized ones also had a rise in their sensitivities, but the magnitude of the rise was a little small in the $10^{-3}$-second exposure.

EXAMPLE 9

After subjecting each of the Emulsions 78 to 80 prepared in Example 8 to optimal chemical sensitization and spectral sensitization, the resulting emulsions were each used as the emulsion for the third layer of the photosensitive material prepared as Sample No. 201 in Example 2 of JP-A-9-146237, and processed in the same manner as in the examples of JP-A-9-146237. In this case also, good results were obtained.

EXAMPLE 10

After subjecting each of the Emulsions 78 to 80 prepared in Example 8 to optimal chemical sensitization and spectral sensitization, the resulting emulsions were each used as the emulsion for the third layer of the photosensitive material prepared as Sample No. 110 in Example 1 of JP-A-10-20462, and processed in the same manner as in the examples of JP-A-10-20462. In this case also, good results were obtained.

EXAMPLE 11

[Emulsion 101: Cubic Silver Chloride Emulsion]

Emulsion 101 was prepared in the same manner as Emulsion 1 in Example 1.

[Emulsions 102 (for Comparison): $[Fe(CN)_6]^{4-}$-doped Cubic Silver Chloride Emulsion]

Emulsion 102 was prepared in the same manner as Emulsion 1 in Example 1, except that $[Fe(CN)_6]^{4-}$ in a concentration of $6.6\times10^{-7}$ M was added to Solution 4.

[Emulsions 103 to 108 (According to the Present Invention): Cubic Silver Chloride Emulsions Doped with Present Ti(IV) Complexes of Formula (II) Respectively]

To 845 ml of a water solution containing 4.5 g of sodium chloride, 25 g of deionized gelatin was added and dissolved therein. To the resulting solution kept at 50° C. with stirring, 140 ml of a 0.21 M aqueous solution of silver nitrate (Solution 5) and 140 ml of a 0.21 M aqueous solution of sodium chloride (Solution 6) were added at a constant flow rate over a 10-minute period in accordance with a double jet method. After a 10-minute lapse, 320 ml of a 2.2 M aqueous solution of silver nitrate (Solution 7), 285 ml of a 2.2 M aqueous solution of sodium chloride (Solution 8) and 35 ml of an ethanol solution containing one of the present Ti(IV) complexes shown in Table 13 (Solution 9) in a concentration of 3.9 mM were further added at a constant flow rate over a 35-minute period in accordance with a triple jet method. After a 5 minute-lapse from the conclusion of the addition, the reaction solution was cooled to 35° C., and the soluble salts were removed therefrom by a general flocculation method. The resulting solution was raised again to 40° C., and additional gelatin was dissolved therein. Further, sodium chloride and phenol were added thereto, and the pH of the emulsion thus prepared was adjusted to 6.5. The emulsion grains formed in the foregoing manner were monodispersed silver chloride cubes having a side length of 0.5 $\mu$m.

The aforementioned emulsions were each admixed with the same additives as used in Example 1, thereby obtaining Emulsions 103 to 108, and coated in the same manner as adopted in Example 1, thereby obtaining coated Samples 301 to 308 respectively.

On the other hand, the emulsions prepared above were each spectrally sensitized with $3.8\times10^{-4}$ mole/mole-Ag of Sensitizing Dye (1), and coated in the same manner as employed for preparing the coated Samples 301 to 308, thereby obtaining coated Samples 309 to 316 and 317 to 324 respectively.

To each of Emulsions 101 to 108, $1.8\times10^{-2}$ mole/mole-Ag of 4-hydroxy-6-methyl-1,3,3a,7-tetrazaindene was added first, and then $2.5\times10^{-6}$ mole/mole-Ag of sodium thiosulflate was added. And the resulting emulsions underwent optimal chemical sensitization at 60° C. Thus, Emulsions 109 to 116 were obtained. These emulsions were coated in the same manner as used for preparing the coated Samples 301 to 308, thereby obtaining coated Samples 325 to 332. On the other hand, the Emulsions 109 to 116 were each spectrally sensitized with $3.8\times10^{-4}$ mole/mole-Ag of Sensitizing Dye (1), and coated in the same manner as used for preparing the coated Samples 301 to 308, thereby obtaining coated Samples 333 to 348.

[Emulsion 117: Cubic Silver Chloride Emulsion]

Emulsion 117 was prepared in the same manner as Emulsion 1 obtained in Example 1.

[Emulsions 118 to 120 (for Comparison): $[Fe(CN)_6]^{-4}$-doped Cubic Silver Chloride Emulsions]

In the same manner as Emulsion 1, except that $[Fe(CN)_6]^{-4}$ was added to Solution 4 in concentrations of $2.2\times10^{-7}$ M, $2.2\times10^{-6}$ M and $2.2\times10^{-5}$ M respectively, Emulsions 118, 119 and 120 were prepared.

[Emulsions 121 to 125 (According to the Present Invention): Cubic Silver Chloride Emulsions Doped With Present Titanium Complex of Formula (II)]

Cubic silver chloride Emulsions 121 to 125 were prepared in the same manner as Emulsion 108, except that the titanium complex concentration in Solution 9 (an ethanol solution containing the present complex $[TiCl_4(2\text{-MeBzIm})_2]^0$ was changed to 1.3 mM, 3.9 mM, 6.5 mM, 39 mM and 390 mM respectively.

After admixed with gelatin and sodium dodecylbenzenesulfonate, each of these Emulsions 117 to 125 was coated at a silver coverage of 2 g/m$^2$ using an extrusion method on a subbing layer-provided triacetyl cellulose film support together with a protective layer containing gelatin, polymethylmethacrylate particles and sodium salt of 2,4-dichloro-6-hydroxy-s-triazine. Thus, coated Samples 349 to 357 were prepared.

Further, each of those Emulsions 117 to 125 was spectrally sensitized by adding thereto $3.8\times10^{-4}$ mole/mole-Ag of Sensitizing Dye (1), and coated in the same manner as mentioned above, thereby preparing coated Samples 358 to 366 and coated Samples 367 to 375.

To each of the foregoing Emulsions 117 to 125, $1.8\times10^{-2}$ mole/mole-Ag of 4-hydroxy-6-methyl-1,3,3a,7-teterazaindene was added first, and then $2.5\times10^{-6}$ mole/mole-Ag of sodium thiosulfate was added. And they underwent optimal chemical sensitization at 60° C. to provide Emulsions 126 to 134 respectively. These chemically sensitized emulsions were each coated in the same manner as mentioned above, thereby providing coated Samples 376 to 384 respectively. Further, each of these chemically sensitized Emulsions 126 to 134 was spectrally sensitized by the addition of $3.8\times10^{-4}$ mole/mole-Ag of Sensitizing Dye (1), and coated in the same manner as mentioned above, thereby providing coated Samples 385 to 393 and coated Samples 394 to 402.

These Samples were each subjected to two different exposure operations (i.e., 10 seconds and $10^{-3}$ second) respectively for sensitometry via an optical wedge, and then developed for 5 minutes at 20° C. with Developer 1 prepared according to the aforementioned formula. Thereafter, each sample underwent sequentially usual stop, fixation, washing and drying operations, and then measured for optical density. The fog density was determined as the minimum optical density of each sample, and the sensitivity was represented by the logarithm of an exposure amount required for providing the optical density of fog+0.1. The sensitivities of Samples are shown as relative values in the tables, with the dopant-free Sample (which is a conventional type, and so referred to as "type") being taken as 100. With respect to the coated Samples 301 to 308 (spectral sensitizing dye-free samples) and the coated Samples 309 to 316 (spectral sensitizing dye-added samples), the sensitivity of each sample shown in Table 13 is relative sensitivity determined when the sample was exposed to light of wavelengths at which the silver halide therein had the intrinsic absorption. And the sensitivities of coated Samples 317 to 324 (spectral sensitizing dye-added samples) shown in Table 13 are relative sensitivities determined when the samples were exposed to light of wavelengths at which the spectral sensitizing dye had the absorption. In Table 14 are shown the relative sensitivities of the coated Samples 325 to 332 (spectral sensitizing dye-free samples) and the coated Samples 333 to 340 (spectral sensitizing dye-added samples) respectively when exposed to light of wavelengths corresponding to the intrinsic absorption of silver halide, and the relative sensitivities of the coated Samples 341 to 348 (spectral sensitizing dye-added samples) respectively when exposed to light of wavelengths corresponding to the absorption by the spectral sensitizing dye. Further, in Tables 15 and 16 are shown the relative sensitivities of the emulsions differing in amount of dopant added. More specifically, the relative sensitivities shown in Table 15 are those which the coated Samples 349 to 357 (spectral sensitizing dye-free samples) and the coated Samples 358 to 366 (spectral sensitizing dye-added samples) showed respectively when exposed to light of wavelengths corresponding to the intrinsic absorption of silver halide, and those of the coated Samples 367 to 375 (spectral sensitizing dye-added samples) respectively when exposed to light of wavelengths corresponding to the absorption by the spectral sensitizing dye. And the relative sensitivities shown in Table 16 are those of the coated Samples 376 to 384 (spectral sensitizing dye-free samples) and the coated Samples 385 to 393 (spectral sensitizing dye-added samples) respectively when exposed to light of wavelengths corresponding to the intrinsic absorption of silver halide, and those of the coated Samples 394 to 402 (spectral sensitizing dye-added samples) respectively when exposed to light of wavelengths corresponding to the absorption by the spectral sensitizing dye. Of those listed in Table 13, the coated Samples 309 to 316 were the same as the coated Samples 317 to 324 respectively; of those listed in Table 14, the coated Samples 333 to 340 were the same as the coated Samples 341 to 348 respectively; of those listed in Table 15, the coated Samples 358 to 366 were the same as the coated Samples 367 to 375 respectively; and, of those listed in Table 16, the coated Samples 385 to 393 were the same as the coated Samples 394 to 402 respectively. However, the samples corresponding to each other were different in wavelengths of exposure light used for sensitometry although the same emulsion was used therein. Therefore, two different numbers were given to the same sample.

TABLE 13

| Sample No.*1 | Emulsion No. | Dopant** | Relative sensitivity*2 10-second exposure | Relative sensitivity*2 $10^{-3}$-second exposure |
|---|---|---|---|---|
| 301 (type) | 101 | not added | 100 | 100 |
| 302 (comparison) | 102 | $[Fe(CN)_6]^{4-}$ | 100 | 98 |
| 303 (invention) | 103 | $[TiCl_4(Im)_2]^0$ | 105 | 100 |
| 304 (invention) | 104 | $[TiCl_4(2\text{-MeIm})_2]^0$ | 107 | 102 |
| 305 (invention) | 105 | $[TiCl_4(2\text{-proIm})_2]^0$ | 110 | 104 |
| 306 (invention) | 106 | $[TiCl_4(2\text{-Et-4-Me-5-CHOIm})_2]^0$ | 110 | 102 |
| 307 (invention) | 107 | $[TiCl_4(BzIm)_2]^0$ | 116 | 106 |
| 308 (invention) | 108 | $[TiCl_4(2\text{-MeBzIm})_2]^0$ | 120 | 107 |
| 309 (type) | 101 | not added | 100 | 100 |
| 310 (comparison) | 102 | $[Fe(CN)_6]^{4-}$ | 96 | 100 |
| 311 (invention) | 103 | $[TiCl_4(Im)_2]^0$ | 116 | 111 |
| 312 (invention) | 104 | $[TiCl_4(2\text{-MeIm})_2]^0$ | 119 | 122 |
| 313 (invention) | 105 | $[TiCl_4(2\text{-proIm})_2]^0$ | 128 | 124 |
| 314 (invention) | 106 | $[TiCl_4(2\text{-Et-4-Me-5-CHOIm})_2]^0$ | 128 | 121 |
| 315 (invention) | 107 | $[TiCl_4(BzIm)_2]^0$ | 129 | 127 |
| 316 (invention) | 108 | $[TiCl_4(2\text{-MeBzIm})_2]^0$ | 135 | 140 |
| 317 (type) | 101 | not added | 100 | 100 |
| 318 (comparison) | 102 | $[Fe(CN)_6]^{4-}$ | 100 | 100 |
| 319 (invention) | 103 | $[TiCl_4(Im)_2]^0$ | 124 | 111 |

TABLE 13-continued

| Sample No.*1 | Emulsion No. | Dopant** | Relative sensitivity*2 10-second exposure | Relative sensitivity*2 $10^{-3}$-second exposure |
|---|---|---|---|---|
| 320 (invention) | 104 | $[TiCl_4(2\text{-}MeIm)_2]^0$ | 121 | 113 |
| 321 (invention) | 105 | $[TiCl_4(2\text{-}proIm)_2]^0$ | 135 | 120 |
| 322 (invention) | 106 | $[TiCl_4(2\text{-}Et\text{-}4\text{-}Me\text{-}5\text{-}CHOIm)_2]^0$ | 145 | 123 |
| 323 (invention) | 107 | $[TiCl_4(BzIm)_2]^0$ | 139 | 125 |
| 316 (invention) | 108 | $[TiCl_4(2\text{-}MeBzIm)_2]^0$ | 147 | 131 |

**The symbols used for ligands in the foregoing dopants are as follows; Im stands for imidazole, 2-MeIm stands for 2-methylimidazole, 2-proIm stands for 2-propylimidazole, 2-Et-4-Me-5-CHOIm stands for 2-ethyl-4-methyl-5-imidazolecarboxyaldehyde, BzIm stands for benzimidazole and 2-MeBzIm stands for 2-methylbenzimidazole.

*1Sample Nos. 301 to 308 were sensitizing dye-free samples, and Sample Nos. 309 to 324 were sensitizing dye-added samples. Sample Nos. 301 to 316 were subjected to blue exposure, while Sample Nos. 317 to 324 were subjected to minus blue exposure.

*2The sensitivities of Sample Nos. 302 to 308 are shown as relative values, with Sample No. 301 being taken as 100; the sensitivities of Sample Nos. 310 to 316 are shown as relative values, with Sample No. 309 being taken as 100; and the sensitivities of Sample Nos. 318 to 324 are shown as relative values, with Sample No. 317 being taken as 100.

TABLE 14

| Sample No.*1 | Emulsion No. | Dopant** | Relative sensitivity*2 10-second exposure | Relative sensitivity*2 $10^{-3}$-second exposure |
|---|---|---|---|---|
| 325 (type) | 109 | not added | 100 | 100 |
| 326 (comparison) | 110 | $[Fe(CN)_6]^{4-}$ | 103 | 100 |
| 327 (invention) | 111 | $[TiCl_4(Im)_2]^0$ | 101 | 100 |
| 328 (invention) | 112 | $[TiCl_4(2\text{-}MeIm)_2]^0$ | 102 | 98 |
| 329 (invention) | 113 | $[TiCl_4(2\text{-}proIm)_2]^0$ | 103 | 101 |
| 330 (invention) | 114 | $[TiCl_4(2\text{-}Et\text{-}4\text{-}Me\text{-}5\text{-}CHOIm)_2]^0$ | 103 | 102 |
| 331 (invention) | 115 | $[TiCl_4(BzIm)_2]^0$ | 105 | 102 |
| 332 (invention) | 116 | $[TiCl_4(2\text{-}MeBzIm)_2]^0$ | 99 | 101 |
| 333 (type) | 109 | not added | 100 | 100 |
| 334 (comparison) | 110 | $[Fe(CN)_6]^{4-}$ | 100 | 99 |
| 335 (invention) | 111 | $[TiCl_4(Im)_2]^0$ | 100 | 100 |
| 336 (invention) | 112 | $[TiCl_4(2\text{-}MeIm)_2]^0$ | 100 | 99 |
| 337 (invention) | 113 | $[TiCl_4(2\text{-}proIm)_2]^0$ | 102 | 102 |
| 338 (invention) | 114 | $[TiCl_4(2\text{-}Et\text{-}4\text{-}Me\text{-}5\text{-}CHOIm)_2]^0$ | 104 | 104 |
| 339 (invention) | 115 | $[TiCl_4(BzIm)_2]^0$ | 105 | 104 |
| 340 (invention) | 116 | $[TiCl_4(2\text{-}MeBzIm)_2]^0$ | 100 | 101 |
| 341 (type) | 109 | not added | 100 | 100 |
| 342 (comparison) | 110 | $[Fe(CN)_6]^{4-}$ | 101 | 103 |
| 343 (invention) | 111 | $[TiCl_4(Im)_2]^0$ | 101 | 101 |
| 344 (invention) | 112 | $[TiCl_4(2\text{-}MeIm)_2]^0$ | 101 | 103 |
| 345 (invention) | 113 | $[TiCl_4(2\text{-}proIm)_2]^0$ | 103 | 104 |
| 346 (invention) | 114 | $[TiCl_4(2\text{-}Et\text{-}4\text{-}Me\text{-}5\text{-}CHOIm)_2]^0$ | 104 | 106 |

TABLE 14-continued

| Sample No.*1 | Emulsion No. | Dopant** | Relative sensitivity*2 10-second exposure | Relative sensitivity*2 $10^{-3}$-second exposure |
|---|---|---|---|---|
| 347 (invention) | 115 | $[TiCl_4(BzIm)_2]^0$ | 103 | 102 |
| 348 (invention) | 116 | $[TiCl_4(2\text{-}MeBzIm)_2]^0$ | 101 | 110 |

**Symbols for ligands in dopants are as follows; Im stands for imidazole, 2-MeIm stands for 2-methylimidazole, 2-proIm stands for 2-propylimidazole, 2-Et-4-Me-5-CHOIm stands for 2-ethyl-4-methyl-5-imidazolecarboxyaldehyde, BzIm stands for benzimidazole and 2-MeBzIm stands for 2-methylbenzimidazole.

*1Sample Nos. 325 to 332 were sensitizing dye-free samples, and Sample Nos. 333 to 348 were sensitizing dye-added samples. Sample Nos. 325 to 340 were subjected to blue exposure, while Sample Nos. 341 to 348 were subjected to minus blue exposure.

*2The sensitivities of Sample Nos. 326 to 332 are shown as relative values, with Sample No. 325 being taken as 100; the sensitivities of Sample Nos. 334 to 340 are shown as relative values, with Sample No. 333 being taken as 100; and the sensitivities of Sample Nos. 342 to 348 are shown as relative values, with Sample No. 341 being taken as 100.

In Table 13 are shown the relative sensitivities of the comparative samples comprising $[Fe(CN)_6]^{4-}$-doped emulsions and those of the present samples comprising titanium complex-doped primitive emulsions. The dopant concentration in every sample was $3\times10^{-7}$ mole per mole of Ag. Under the doping condition adopted herein, even the emulsions doped with $[Fe(CN)_6]^{4-}$ well known as a sensitivity increasing dopant showed no clear increase in sensitivity because of insufficiency in dopant content. In contrast, a clear increase in sensitivity was observed in all the emulsions doped with the present titanium complexes, irrespective of what imidazole compounds were contained therein as ligands. In particular, those titanium complexes had greater sensitivity-increasing effects upon sensitizing dye-added samples than sensitizing dye-free samples. In addition, the magnitude of a sensitivity-increasing effect was found to depend on the species of substituents present in the imidazole ligands, and the greatest effect was produced by the titanium complex containing 2-methylbenzimidazole as ligands.

In Table 14 are shown the relative sensitivities of sulfur-sensitized emulsions. The sensitivity-increasing effect obtained when the present titanium complex-doped emulsions underwent sulfur sensitization was smaller than that obtained when the present titanium complex-doped emulsions were not subjected to after-ripening. Compared with the $[Fe(CN)_6]^{4-}$-doped emulsions which had a sensitivity increasing effect by undergoing sulfur sensitization, however, most of the titanium complex-doped emulsions surpassed in increment of sensitivity.

TABLE 15

| Sample No.*1 | Emulsion No. | Dopant | Amount added (mol/mol Ag) | Relative sensitivity*2 10-second exposure | Relative sensitivity*2 $10^{-3}$-second exposure |
|---|---|---|---|---|---|
| 349 (type) | 117 | not added | — | 100 | 100 |
| 350 (compar.) | 118 | $[Fe(CN)_6]^{4-}$ | $1 \times 10^{-7}$ | 100 | 100 |
| 351 (compar.) | 119 | $[Fe(CN)_6]^{4-}$ | $1 \times 10^{-6}$ | 100 | 99 |
| 352 (compar.) | 120 | $[Fe(CN)_6]^{4-}$ | $1 \times 10^{-5}$ | 98 | 92 |
| 353 (invention) | 121 | $[TiCl_4(2MeBzIm)_2]^0$ | $1 \times 10^{-7}$ | 116 | 101 |
| 354 (invention) | 122 | $[TiCl_4(2MeBzIm)_2]^0$ | $3 \times 10^{-7}$ | 120 | 107 |
| 355 (invention) | 123 | $[TiCl_4(2MeBzIm)_2]^0$ | $5 \times 10^{-7}$ | 117 | 100 |
| 356 (invention) | 124 | $[TiCl_4(2MeBzIm)_2]^0$ | $1 \times 10^{-6}$ | 114 | 99 |
| 357 (invention) | 125 | $[TiCl_4(2MeBzIm)_2]^0$ | $1 \times 10^{-5}$ | 110 | 94 |
| 358 (type) | 117 | not added | — | 100 | 100 |
| 359 (compar.) | 118 | $[Fe(CN)_6]^{4-}$ | $1 \times 10^{-7}$ | 96 | 95 |
| 360 (compar.) | 119 | $[Fe(CN)_6]^{4-}$ | $1 \times 10^{-6}$ | 97 | 95 |
| 361 (compar.) | 120 | $[Fe(CN)_6]^{4-}$ | $1 \times 10^{-5}$ | 97 | 91 |
| 362 (invention) | 121 | $[TiCl_4(2MeBzIm)_2]^0$ | $1 \times 10^{-7}$ | 124 | 112 |
| 363 (invention) | 122 | $[TiCl_4(2MeBzIm)_2]^0$ | $3 \times 10^{-7}$ | 135 | 140 |
| 364 (invention) | 123 | $[TiCl_4(2MeBzIm)_2]^0$ | $5 \times 10^{-7}$ | 127 | 128 |
| 365 (invention) | 124 | $[TiCl_4(2MeBzIm)_2]^0$ | $1 \times 10^{-6}$ | 122 | 107 |
| 366 (invention) | 125 | $[TiCl_4(2MeBzIm)_2]^0$ | $1 \times 10^{-5}$ | 118 | 104 |
| 367 (type) | 117 | not added | — | 100 | 100 |
| 368 (compar.) | 118 | $[Fe(CN)_6]^{4-}$ | $1 \times 10^{-7}$ | 100 | 100 |
| 369 (compar.) | 119 | $[Fe(CN)_6]^{4-}$ | $1 \times 10^{-6}$ | 100 | 100 |
| 370 (compar.) | 120 | $[Fe(CN)_6]^{4-}$ | $1 \times 10^{-5}$ | 106 | 100 |
| 371 (invention) | 121 | $[TiCl_4(2MeBzIm)_2]^0$ | $1 \times 10^{-7}$ | 115 | 114 |
| 372 (invention) | 122 | $[TiCl_4(2MeBzIm)_2]^0$ | $3 \times 10^{-7}$ | 147 | 131 |
| 373 (invention) | 123 | $[TiCl_4(2MeBzIm)_2]^0$ | $5 \times 10^{-7}$ | 142 | 127 |
| 374 (invention) | 124 | $[TiCl_4(2MeBzIm)_2]^0$ | $1 \times 10^{-6}$ | 137 | 121 |
| 375 (invention) | 125 | $[TiCl_4(2MeBzIm)_2]^0$ | $1 \times 10^{-5}$ | 135 | 113 |

*1Sample Nos. 349 to 357 were sensitizing dye-free samples, and Sample Nos. 358 to 375 were sensitizing dye-added samples. Sample Nos. 349 to 366 were subjected to blue exposure, while Sample Nos. 367 to 375 were subjected to minus blue exposure.

*2The sensitivities of Sample Nos. 350 to 357 are shown as relative values, with Sample No. 349 being taken as 100; the sensitivities of Sample Nos. 359 to 366 are shown as relative values, with Sample No. 358 being taken as 100; and the sensitivities of Sample Nos. 368 to 375 are shown as relative values, with Sample No. 367 being taken as 100.

TABLE 16

| Sample No.*1 | Emulsion No. | Dopant | Amount added (mol/mol Ag) | Relative sensitivity*2 10-second exposure | Relative sensitivity*2 $10^{-3}$-second exposure |
|---|---|---|---|---|---|
| 376 (type) | 126 | not added | — | 100 | 100 |
| 377 (compar.) | 127 | $[Fe(CN)_6]^{4-}$ | $1 \times 10^{-7}$ | 102 | 100 |
| 378 (compar.) | 128 | $[Fe(CN)_6]^{4-}$ | $1 \times 10^{-6}$ | 103 | 99 |
| 379 (compar.) | 129 | $[Fe(CN)_6]^{4-}$ | $1 \times 10^{-5}$ | 106 | 92 |
| 380 (invention) | 130 | $[TiCl_4(2\text{-}MeBzIm)_2]^0$ | $1 \times 10^{-7}$ | 100 | 100 |
| 381 (invention) | 131 | $[TiCl_4(2\text{-}MeBzIm)_2]^0$ | $3 \times 10^{-7}$ | 99 | 101 |
| 382 (invention) | 132 | $[TiCl_4(2\text{-}MeBzIm)_2]^0$ | $5 \times 10^{-7}$ | 100 | 101 |
| 383 (invention) | 133 | $[TiCl_4(2\text{-}MeBzIm)_2]^0$ | $1 \times 10^{-6}$ | 100 | 100 |
| 384 (invention) | 134 | $[TiCl_4(2\text{-}MeBzIm)_2]^0$ | $1 \times 10^{-5}$ | 99 | 101 |
| 385 (type) | 126 | not added | — | 100 | 100 |
| 386 (compar.) | 127 | $[Fe(CN)_6]^{4-}$ | $1 \times 10^{-7}$ | 100 | 95 |
| 387 (compar.) | 128 | $[Fe(CN)_6]^{4-}$ | $1 \times 10^{-6}$ | 100 | 95 |
| 388 (compar.) | 129 | $[Fe(CN)_6]^{4-}$ | $1 \times 10^{-5}$ | 99 | 91 |
| 389 (invention) | 130 | $[TiCl_4(2\text{-}MeBzIm)_2]^0$ | $1 \times 10^{-7}$ | 100 | 102 |
| 390 (invention) | 131 | $[TiCl_4(2\text{-}MeBzIm)_2]^0$ | $3 \times 10^{-7}$ | 100 | 102 |
| 391 (invention) | 132 | $[TiCl_4(2\text{-}MeBzIm)_2]^0$ | $5 \times 10^{-7}$ | 102 | 106 |
| 392 (invention) | 133 | $[TiCl_4(2\text{-}MeBzIm)_2]^0$ | $1 \times 10^{-6}$ | 105 | 104 |
| 393 (invention) | 134 | $[TiCl_4(\text{-}2MeBzIm)_2]^0$ | $1 \times 10^{-5}$ | 98 | 100 |
| 394 (type) | 126 | not added | — | 100 | 100 |
| 395 (compar.) | 127 | $[Fe(CN)_6]^{4-}$ | $1 \times 10^{-7}$ | 101 | 100 |
| 396 (compar.) | 128 | $[Fe(CN)_6]^{4-}$ | $1 \times 10^{-6}$ | 102 | 100 |
| 397 (compar.) | 129 | $[Fe(CN)_6]^{4-}$ | $1 \times 10^{-5}$ | 103 | 100 |
| 398 (invention) | 130 | $[TiCl_4(2\text{-}MeBzIm)_2]^0$ | $1 \times 10^{-7}$ | 101 | 102 |
| 399 (invention) | 131 | $[TiCl_4(2\text{-}MeBzIm)_2]^0$ | $3 \times 10^{-7}$ | 101 | 110 |
| 400 (invention) | 132 | $[TiCl_4(2\text{-}MeBzIm)_2]^0$ | $5 \times 10^{-7}$ | 104 | 107 |

TABLE 16-continued

| Sample No.*1 | Emulsion No. | Dopant | Amount added (mol/mol Ag) | Relative sensitivity*2 10-second exposure | Relative sensitivity*2 $10^{-3}$-second exposure |
|---|---|---|---|---|---|
| 401 (invention) | 133 | $[TiCl_4(2\text{-}MeBzIm)_2]^0$ | $1 \times 10^{-6}$ | 103 | 104 |
| 402 (invention) | 134 | $[TiCl_4(2\text{-}MeBzIm)_2]^0$ | $1 \times 10^{-5}$ | 100 | 103 |

*1Sample Nos. 376 to 384 were sensitizing dye-free samples, and Sample Nos. 385 to 402 were sensitizing dye-added samples. Sample Nos. 376 to 393 were subjected to blue exposure, while Sample Nos. 394 to 402 were subjected to minus blue exposure.
*2The sensitivities of Sample Nos. 377 to 384 are shown as relative values, with Sample No. 376 being taken as 100; the sensitivities of Sample Nos. 386 to 393 are shown as relative values, with Sample No. 385 being taken as 100; and the sensitivities of Sample Nos. 395 to 402 are shown as relative values, with Sample No. 394 being taken as 100.

The relative sensitivities of the emulsions doped with $[TiCl_4(2\text{-}MeBzIm)_2]^0$ (which was known to have the greatest sensitivity-increasing effect from Tables 13 and 14) in different concentrations respectively but subjected to no after-ripening treatment were compared with the relative sensitivities of the $[Fe(CN)_6]^{4-}$-doped emulsions (Table 15). More specifically, it can be seen from Table 15 that all the present $[TiCl_4(2\text{-}MeBzIm)_2]^0$-doped emulsions got much greater increase in sensitivity than the $[Fe(CN)_6]^{4-}$-doped emulsions. In the case of using this titanium complex as dopant, the greatest increase in sensitivity was attained when the amount of the dopant added was $3\times10^{-7}$ mole per mole of Ag. Further, the sensitivity-increasing effects were greater in the cases where the spectral sensitizing dye was added, especially when the exposure was carried out with light of wavelengths corresponding to the absorption by the spectral sensitizing dye. In contrast, it was detected in the $[Fe(CN)_6]^{-4}$-doped emulsions that, when the exposure was carried out with light of wavelengths corresponding to the intrinsic absorption of silver halide, the internal sensitivity was increased with an increase in the amount of the Fe complex as dopant but the sensitivity at the grain surface was decreased. As a result, the sensitivities of these Fe complex-doped emulsions were not as high as those of the present Ti complex-doped emulsions. In the cases where the Fe complex-doped emulsions were exposed to light of wavelengths corresponding to the absorption by the spectral sensitizing dye, the loss of surface sensitivity was small, and the sensitivity increased with an increase in dopant concentration. However, the increment of the sensitivity was nowhere near as great as that attained by the present Ti complex-toped emulsions. On the other hand, the relative sensitivities of the emulsions doped with the foregoing complexes and further sensitized with the sulfur compound are shown in Table 16. Therein also, positive effects were observed in the Ti complex-doped, sensitizing dye-added emulsions. In particular, the sensitivity-increasing effect was great in the cases of exposing such emulsions to light of wavelengths corresponding to the absorption by the sensitizing dye, and the greatest effect was obtained when the amount of the Ti complex added as dopant was $5\times10^{-7}$ mole per mole of Ag. Further, it was found that the present emulsions, irrespective of dopant concentration, had greater increase in sensitivity than the $[Fe(CN)_6]^{4-}$-doped emulsions.

Additionally, Ru complex-doped and Mn complex-doped silver chloride emulsions were prepared in the same manner as the foregoing Ti complex-doped emulsions. The doping with the Ru complexes caused desensitization and an increase of contrast in the emulsions, while the doping with the Mn complexes caused desensitization alone in the emulsions.

EXAMPLE 12

[Emulsions 135, 151 and 157: Preparation of Cubic Silver Bromide Emulsions]

To 870 ml of water were added 36 g of deionized gelatin and 0.25 g of potassium bromide to prepare a solution. To this gelatin solution kept at 75° C. with stirring, 36 ml of a 0.088 M aqueous solution of silver nitrate (Solution 10) and 36 ml of a 0.088 M aqueous solution of potassium bromide (Solution 11) were added at a constant flow rate over a 10-minute period in accordance with a double jet method, and further 176 ml of Solution 10 and 176 ml of Solution 11 were added over a 7-minute period in accordance with a double jet method. Thereafter, 898 ml of a 0.82 M aqueous solution of silver nitrate (Solution 12) was added over a 95-minute period at an increased flow rate, beginning with the flow rate of 0.53 ml/min, and simultaneously therewith a 0.90 M aqueous solution of potassium bromide (Solution 13) was added while controlling so that the pBr was kept at 4.66. After the 5 minute-lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and phenol, and adjusted to pH 6.5. The emulsion grains formed in the foregoing manner were monodispersed silver bromide cubes having a side length of 0.5 $\mu$m.

[Emulsions 136 to 142 (According to the Present Invention): Cubic Silver Bromide Emulsions Doped with Present Mn(II) Complexes of Formula (II) Respectively]

Emulsions 136 to 142 were prepared in the same manner as Emulsion 135, except that any of the present Mn(II) complexes shown in Table 17 was contained in Solution 13 in concentrations of $8.2\times10^{-8}$ M (Emulsions 136 and 139), $8.2\times10^{-7}$ M (Emulsions 137, 140 and 142) and $8.2\times10^{-6}$ M (Emulsions 138 and 141) respectively.

[Emulsions 152 to 153 (According to the Present Invention: Cubic Silver Bromide Emulsions Doped with Present Ru(III) Complexes of Formula (II) Respectively]

Emulsions 152 and 153 were prepared in the same manner as Emulsion 151, except that the present Ru(III) complexes shown in Table 18 were each contained in Solution 13 in concentration of $8.2\times10^{-7}$ M.

[Emulsions 158 to 162 (According To the Present Invention: Cubic Silver Bromide Emulsions Doped with Oresent Ti(IV) Complexes of Formula (II) Respectively]

Emulsions 158 to 162 were prepared in the same manner as Emulsion 157, except that the present Ti(IV) complexes shown in Table 19 were each contained in Solution 13 in concentration of $8.2\times10^{-7}$ M.

Each of the aforementioned silver bromide Emulsions 135 to 142, 151 to 153 and 157 to 162 was admixed with $1.2\times10^{-4}$ mole/mole-Ag of sodium thiosulfate, and underwent optimal chemical sensitization at 60° C. Thus, Emulsions 143 to 150, 154 to 156 and 163 to 168 (i.e., sulfur-sensitized emulsions) were prepared respectively. These chemically sensitized emulsions were coated in the same manner as in Example 5, thereby preparing coated Samples 427 to 434 and 460 to 462 respectively. On the other hand, those chemically sensitized emulsions were each spectrally sensitized by the addition of $4.9\times10^{-4}$ mole/mole-Ag of the same Sensitizing Dye (1) as used in Example 1, thereby preparing coated Samples 435 to 450, 463 to 468 and 475 to 480 respectively.

These Samples were each subjected to two different exposure operations (i.e., 1 second and $10^{-3}$ second) respectively for sensitometry via an optical wedge, and then developed for 10 minutes at 20° C. with Developer 2 prepared according to the formulation described hereinbefore. Then, each sample underwent sequentially stop, fixation, washing and drying operations, and then measured for optical density. The fog density was determined as the minimum optical density of each sample, and the sensitivity was represented by the logarithm of an exposure amount required for providing the optical density of fog+0.1. The sensitivities of Samples are shown as relative values, with the dopant-free Sample (which is a conventional type, and so referred to as "type") being taken as 100. In Table 17 are shown the relative sensitivities of the Mn complex-containing coated Samples 435 to 442 (chemically sensitized, spectral sensitizing dye-added samples) respectively when exposed to light of wavelengths corresponding to the intrinsic absorption of silver halide, and the relative sensitivities of the coated Samples 443 to 450 (chemically sensitized, spectral sensitizing dye-added samples) respectively when exposed to light of wavelengths corresponding to the absorption by the spectral sensitizing dye. In Table 18 are shown the relative sensitivities of the Ru complex-containing coated Samples 460 to 462 (chemically sensitized, spectral sensitizing dye-free samples) and coated Samples 463 to 465 (chemically sensitized, spectral sensitizing dye-added samples) respectively when exposed to light of wavelengths corresponding to the intrinsic absorption of silver halide, and the relative sensitivities of the coated Samples 466 to 468 (chemically sensitized, spectral sensitizing dye-added samples) respectively when exposed to light of wavelengths corresponding to the absorption by the spectral sensitizing dye. Further, in Table 19 are shown the relative sensitivities of the Ti complex-containing coated Samples 475 to 480 (chemically sensitized, spectral sensitizing dye-added samples) respectively when exposed to light of wavelengths corresponding to the absorption by the spectral sensitizing dye. In Tables 17 and 18 each, the samples in the second group are the same as those in the third group respectively but numbered differently as the corresponding samples were exposed to light different in wavelength.

TABLE 17

| Sample No.*1 | Emulsion No. | Dopant | Amount added (mol/mol Ag) | Relative sensitivity*2 1-second exposure | Relative sensitivity*2 $10^{-3}$-second exposure |
|---|---|---|---|---|---|
| 427 (type) | 143 | not added | — | 100 | 100 |
| 428 (invention) | 144 | $[MnCl_4(Im)_2]^{2-}$ | $1\times10^{-7}$ | 108 | 102 |
| 429 (invention) | 145 | $[MnCl_4(Im)_2]^{2-}$ | $1\times10^{-6}$ | 103 | 100 |
| 430 (invention) | 146 | $[MnCl_4(Im)_2]^{2-}$ | $1\times10^{-5}$ | 100 | 100 |
| 431 (invention) | 147 | $[MnCl_4(2\text{-MeIm})_2]^{2-}$ | $1\times10^{-7}$ | 100 | 100 |
| 432 (invention) | 148 | $[MnCl_4(2\text{-MeIm})_2]^{2-}$ | $1\times10^{-6}$ | 100 | 101 |
| 433 (invention) | 149 | $[MnCl_4(2\text{-MeIm})_2]^{2-}$ | $1\times10^{-5}$ | 103 | 103 |
| 434 (invention) | 150 | $[MnCl_4(2\text{-proIm})_2]^{2-}$ | $1\times10^{-6}$ | 100 | 100 |
| 435 (type) | 143 | not added | — | 100 | 100 |
| 436 (invention) | 144 | $[MnCl_4(Im)_2]^{2-}$ | $1\times10^{-7}$ | 108 | 112 |
| 437 (invention) | 145 | $[MnCl_4(Im)_2]^{2-}$ | $1\times10^{-6}$ | 109 | 112 |
| 438 (invention) | 146 | $[MnCl_4(Im)_2]^{2-}$ | $1\times10^{-5}$ | 108 | 114 |
| 439 (invention) | 147 | $[MnCl_4(2\text{-MeIm})_2]^{2-}$ | $1\times10^{-7}$ | 105 | 104 |
| 440 (invention) | 148 | $[MnCl_4(2\text{-MeIm})_2]^{2-}$ | $1\times10^{-6}$ | 111 | 111 |
| 441 (invention) | 149 | $[MnCl_4(2\text{-MeIm})_2]^{2-}$ | $1\times10^{-5}$ | 105 | 107 |
| 442 (invention) | 150 | $[MnCl_4(2\text{-proIm})_2]^{2-}$ | $1\times10^{-6}$ | 103 | 104 |
| 443 (type) | 143 | not added | — | 100 | 100 |
| 444 (invention) | 144 | $[MnCl_4(Im)_2]^{2-}$ | $1\times10^{-7}$ | 108 | 115 |
| 445 (invention) | 145 | $[MnCl_4(Im)_2]^{2-}$ | $1\times10^{-6}$ | 109 | 114 |
| 446 (invention) | 146 | $[MnCl_4(Im)_2]^{2-}$ | $1\times10^{-5}$ | 109 | 112 |
| 447 (invention) | 147 | $[MnCl_4(2\text{-MeIm})_2]^{2-}$ | $1\times10^{-7}$ | 100 | 105 |
| 448 (invention) | 148 | $[MnCl_4(2\text{-MeIm})_2]^{2-}$ | $1\times10^{-6}$ | 110 | 111 |
| 449 (invention) | 149 | $[MnCl_4(2\text{-MeIm})_2]^{2-}$ | $1\times10^{-5}$ | 111 | 106 |
| 450 (invention) | 150 | $[MnCl_4(2\text{-proIm})_2]^{2-}$ | $1\times10^{-6}$ | 101 | 100 |

*1Sample Nos. 427 to 434 were sensitizing dye-free samples, and Sample Nos. 435 to 450 were sensitizing dye-added samples. Sample Nos. 427 to 442 were subjected to blue exposure, while Sample Nos. 443 to 450 were subjected to minus blue exposure.
*2The sensitivities of Sample Nos. 428 to 434 are shown as relative values, with Sample No. 427 being taken as 100; the sensitivities of Sample Nos. 436 to 442 are shown as relative values, with Sample No. 435 being taken as 100; and the sensitivities of Sample Nos. 444 to 450 are shown as relative values, with Sample No. 443 being taken as 100.

In Table 17 are shown the relative sensitivities of the Mn complex-doped cubic silver bromide emulsions. As the ligands in these Mn complexes were used imidazole (Im), 2-methylimidazole (2-MeIm) and 2-propylimidazole (2-proIm) respectively.

In the emulsion doped with these complexes, the samples in which the sensitizing dye was added tended to increase the change in sensitivity. Also, although it was difficult to find a clear correlation between the change in sensitivity and the amount of the complexes, the change in sensitivity tended to become largest when $1\times10^{-6}$ mol/mol-Ag of complexes was added.

TABLE 18

| Sample No.*1 | Emulsion No.*2 | Dopant** | Relative sensitivity*3 1-second exposure | Relative sensitivity*3 $10^{-3}$-second exposure |
|---|---|---|---|---|
| 460 (type) | 154 | not added | 100 | 100 |
| 461 (invention) | 155 | $[RuCl_4(2\text{-MeIm})_2]^-$ | 100 | 100 |
| 462 (invention) | 156 | $[RuCl_4(5\text{-CHOIm})_2]^-$ | 104 | 106 |
| 463 (type) | 154 | not added | 100 | 100 |
| 464 (invention) | 155 | $[RuCl_4(2\text{-MeIm})_2]^-$ | 115 | 114 |
| 465 (invention) | 156 | $[RuCl_4(5\text{-CHOIm})_2]^-$ | 113 | 109 |
| 466 (type) | 154 | not added | 100 | 100 |
| 467 (invention) | 155 | $[RuCl_4(2\text{-MeIm})_2]^-$ | 110 | 109 |
| 468 (invention) | 156 | $[RuCl_4(5\text{-CHOIm})_2]^-$ | 109 | 102 |

**The symbols 2-MeIm and 5-CHOIm used for ligands in the foregoing dopants stand for 2-methylimidazole and 5-imdazolecarboxyaldehyde respectively.
*1Sample Nos. 460 to 462 were sensitizing dye-free samples, and Sample Nos. 464 to 468 were sensitizing dye-added samples. Sample Nos. 460 to 465 were subjected to blue exposure, while Sample Nos. 466 to 468 were subjected to minus blue exposure.
*2All the emulsions shown above are emulsions which had undergone sulfur sensitization.
*3The sensitivities of Sample Nos. 461 to 462 are shown as relative values, with Sample No. 460 being taken as 100; the sensitivities of Sample Nos. 464 to 465 are shown as relative values, with Sample No. 463 being taken as 100; and the sensitivities of Sample Nos. 467 to 468 are shown as relative values, with Sample No. 466 being taken as 100.

The Ru complex-doped emulsions had a tendency similar to that of the Mn complex-doped emulsions, and showed a clear rise in sensitivity in the cases where they had undergone spectral sensitization.

TABLE 19

| Sample No.*1 | Emulsion No.*2 | Dopant** | Relative sensitivity*3 (1-second exposure) |
|---|---|---|---|
| 475 (type) | 163 | not added | 100 |
| 476 (invention) | 164 | $[TiCl_4(2\text{-proIm})_2]^0$ | 107 |
| 477 (invention) | 165 | $[TiCl_4(2\text{-Ey-4-Me-5-CHOIm})_2]^0$ | 107 |
| 478 (invention) | 166 | $[TiCl_4(BzIm)_2]^0$ | 110 |
| 479 (invention) | 167 | $[TiCl_4(2\text{-MeBzIm})_2]^0$ | 109 |
| 480 (invention) | 168 | $[TiCl_4(2\text{-}NH_2BzIm)_2]^0$ | 108 |

**The symbols for ligands in the foregoing dopants are as follows; 2-proIm stands for 2-propylimidazole, 2-Et-4-Me-5-CHOIm stands for 2-ethyl-4-methyl-5-imidazolecarboxyaldehyde, BzIm stands for benzimidazole, 2-MeBzIm stands for 2-methylbenzimidazole and 2-$NH_2$BzIm stands for 2-aminobenzimidazole.
*1All the samples shown above are sensitizing dye-added samples, and underwent minus blue exposure.
*2All the emulsions shown above are emulsions which had undergone sulfur sensitization.
*3The sensitivities of Sample Nos. 476 to 480 are shown as relative values, with Sample No. 475 being taken as 100.

In Table 19 are shown the relative sensitivities of the chemically sensitized, spectral sensitizing dye-added samples when exposed to light of wavelengths corresponding to the absorption by the spectral sensitizing dye.

It can be seen from Table 19 that the chemical sensitization caused an increase of surface sensitivity in the Ti complex-doped emulsions to confer high sensitivity upon them, as compared with the dopant-free emulsion.

EXAMPLE 13

[Emulsion 169: Preparation of Octahedral Silver Halide Emulsion]

To 870 ml of water were added 36 g of deionized gelatin and 0.25 g of potassium bromide to prepare a solution. To this gelatin solution kept at 75° C. with stirring, 36 ml of a 0.088 M aqueous solution of silver nitrate (Solution 14) and 36 ml of a 0.088 M aqueous solution of potassium bromide (Solution 15) were added at a constant flow rate over a 10-minute period in accordance with a double jet method, and further 176 ml of Solution 14 and 176 ml of Solution 15 were added over a 7-minute period in accordance with a double jet method. Thereafter, 898 ml of a 0.82 M aqueous solution of silver nitrate (Solution 16) was added over a 95-minute period at an increased flow rate, beginning with the flow rate of 0.53 ml/min, and simultaneously therewith a 0.90 M aqueous solution of potassium bromide (Solution 17) was added while controlling so that the pBr was kept at 2.93. After the 5 minute-lapse from the conclusion of the addition, the reaction solution was cooled to 35° C., and the soluble salts were removed therefrom by a general flocculation method. The resulting solution was raised again to 40° C., and additional gelatin in an amount of 50 g was dissolved therein. The emulsion thus prepared was admixed with potassium bromide and phenol, and adjusted to pH 6.5. The emulsion grains formed in the foregoing manner were monodispersed silver bromide octahedrons having a sphere equivalent diameter of 0.5 $\mu$m.

[Emulsions 170 to 175 (According to the Present Invention): Octahedral Silver Bromide Emulsions Doped with Present Mn(II) or Ti(IV) Complexes of Formula (II) Respectively]

Emulsions 170 to 175 were prepared in the same manner as Emulsion 169, except that any of the present Mn(II) or Ti(IV) complexes shown in Table 20 was contained in Solution 17 in concentrations of $8.2\times10^{-7}$ M.

Each of the aforementioned silver bromide Emulsions 169 to 175 was admixed with $8.0\times10^{-6}$ mole/mole-Ag of sodium thiosulfate, $9.6\times10^{-6}$ mole/mole-Ag of chloroauric acid and $3.4\times10^{-4}$ mole/mole-Ag of potassium thiocyanate, and subjected to optimal chemical sensitization at 60° C. Thus, Emulsions 176 to 182 were prepared respectively. These chemically sensitized emulsions were coated in the same manner as in Example 5, thereby preparing coated Samples 502 to 508 respectively. On the other hand, those chemically sensitized emulsions were each spectrally sensitized by the addition of $4.9\times10^{-4}$ mole/mole-Ag of the same Sensitizing Dye (1) as used in Example 1, thereby preparing coated Samples 509 to 522 respectively.

These Samples were each subjected to two different exposure operations (1 seconds and $10^{-3}$ second) respectively for sensitometry via an optical wedge, and then developed for 10 minutes at 20° C. with the same Developer 2 as used in Example 5. Then, each sample underwent sequentially usual stop, fixation, washing and drying operations, and then measured for optical density. The fog density was determined as the minimum optical density of each sample, and the sensitivity was represented by the logarithm of an exposure amount required for providing the optical density of fog+0.1. The sensitivities of Samples are shown as relative values, with the dopant-free Sample (which is a conventional type, and so referred to as "type") being taken as 100. In Table 20 are shown the relative sensitivities of the coated Samples 502 to 508 (chemically sensitized, spectral sensitizing dye-free samples) and the coated Samples 509 to 515 (chemically sensitized, spectral sensitizing dye-added samples) respectively when exposed to light of wavelengths corresponding to the intrinsic absorption of silver halide, and the relative sensitivities which the coated Samples 516 to 522 (chemically sensitized, spectral sensitizing dye-added samples) showed respectively when exposed to light of wavelengths corresponding to the absorption by the spectral sensitizing dye. Additionally, the samples in the second group are the same as those in the third group respectively but numbered differently as the corresponding samples were exposed to light different in wavelength.

TABLE 20

| Sample No.*1 | Emulsion No. | Dopant | Relative sensitivity*2 10-second exposure | Relative sensitivity*2 $10^{-3}$-second exposure |
|---|---|---|---|---|
| 502 (type) | 176 | not added | 100 | 100 |
| 503 (invention) | 177 | $[MnCl_4(Im)_2]^{2-}$ | 109 | 108 |
| 504 (invention) | 178 | $[MnCl_4(2\text{-}MeIm)_2]^{2-}$ | 97 | 100 |
| 505 (invention) | 179 | $[MnCl_4(2\text{-}proIm)_2]^{2-}$ | 100 | 100 |
| 506 (invention) | 180 | $[TiCl_4(2\text{-}proIm)_2]^0$ | 100 | 100 |
| 507 (invention) | 181 | $[TiCl_4(2\text{-}Et\text{-}4\text{-}Me\text{-}5\text{-}CHOIm)_2]^0$ | 99 | 100 |
| 508 (invention) | 182 | $[TiCl_4(BzIm)_2]^0$ | 100 | 100 |
| 509 (type) | 176 | not added | 100 | 100 |
| 510 (invention) | 177 | $[MnCl_4(Im)_2]^{2-}$ | 113 | 111 |
| 511 (invention) | 178 | $[MnCl_4(2\text{-}MeIm)_2]^{2-}$ | 115 | 112 |
| 512 (invention) | 179 | $[MnCl_4(2\text{-}proIm)_2]^{2-}$ | 118 | 109 |
| 513 (invention) | 180 | $[TiCl_4(2\text{-}proIm)_2]^0$ | 109 | 102 |
| 514 (invention) | 181 | $[TiCl_4(2\text{-}Et\text{-}4\text{-}Me\text{-}5\text{-}CHOIm)_2]^0$ | 109 | 104 |
| 515 (invention) | 182 | $[TiCl_4(BzIm)_2]^0$ | 126 | 111 |
| 516 (type) | 176 | not added | 100 | 100 |
| 517 (invention) | 177 | $[MnCl_4(Im)_2]^{2-}$ | 110 | 111 |
| 518 (invention) | 178 | $[MnCl_4(2\text{-}MeIm)_2]^{2-}$ | 114 | 105 |
| 519 (invention) | 179 | $[MnCl_4(2\text{-}proIm)_2]^{2-}$ | 113 | 109 |
| 520 (invention) | 180 | $[TiCl_4(2\text{-}proIm)_2]^0$ | 106 | 100 |
| 521 (invention) | 181 | $[TiCl_4(2\text{-}Et\text{-}4\text{-}Me\text{-}5\text{-}CHOIm)_2]^0$ | 100 | 100 |
| 522 (invention) | 182 | $[TiCl_4(BzIm)_2]^0$ | 112 | 105 |

**The symbols used for ligands in the foregoing dopants are as follows; Im stands for imidazole, 2-MeIm stands for 2-methylimidazole, 2-proIm stands for 2-propylimidazole, 2-Et-4-Me-5-CHOIm stands for 2-ethyl-4-methyl-5-imidazolecarboxyaldehyde and BzIm stands for benzimidazole.

*1Sample Nos. 502 to 508 were sensitizing dye-free samples, and Sample Nos. 509 to 522 were sensitizing dye-added samples. Sample Nos. 502 to 515 were subjected to blue exposure, while Sample Nos. 516 to 522 were subjected to minus blue exposure.

*2The sensitivities of Sample Nos. 503 to 508 are shown as relative values, with Sample No. 502 being taken as 100; the sensitivities of Sample Nos. 510 to 515 are shown as relative values, with Sample No. 509 being taken as 100; and the sensitivities of Sample Nos. 517 to 522 are shown as relative values, with Sample No. 516 being taken as 100.

In the samples in which the sensitizing dye was added, large sensitivity-increasing effect was observed in most of the foregoing doped octahedral silver bromide emulsions. Of the Mn complexes, $[MnCl_4(2\text{-}proIm)_2]^{2-}$ had the greatest sensitivity-increasing effect on the sensitizing dye-added octahedral silver bromide emulsions although its effect on the cubic emulsions was the smallest. Of the Ti complexes, $[TiCl_4(BzIm)_2]^0$ had the greatest sensitivity-increasing effect on the sensitizing dye-added octahedral silver bromide emulsions.

EXAMPLE 14

After subjecting each of the octahedral silver bromide Emulsions 176 to 182 prepared in Example 13 to optimal chemical sensitization and spectral sensitization, the resulting emulsions were each used as the emulsion for the third layer of the photosensitive material prepared as Sample No. 201 in Example 2 of JP-A-9-146237, and processed in the same manner as in the examples of JP-A-9-146237. In this case also, good results were obtained.

EXAMPLE 15

After subjecting each of the octahedral silver bromide Emulsions 176 to 182 prepared in Example 13 to optimal chemical sensitization and spectral sensitization, the resulting emulsions were each used as the emulsion for the third layer of the photosensitive material prepared as Sample No. 110 in Example 1 of JP-A-10-20462, and processed in the same manner as in the examples of JP-A-10-20462. In this case also, good results were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein said emulsion contains a compound represented by the following formula (I) or (II):

$$[ML_xL^I_{(4-x)}]^n \quad \text{(I)}$$

wherein M represents a metal or a metal ion; L represents a compound of the following formula (III) which is bonded to M; x represents 1, 2, 3 or 4; n represents an integer of from −6 to +5; and $L^I$ represents a chemical species bonded to M, and $L^I_{(4-x)}$ may be the same or different chemical species when x is 1 or 2;

(III)

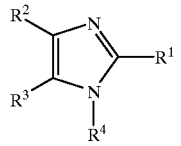

wherein $R_1$, $R_2$, $R_3$ and $R_4$ each represent a hydrogen atom, an alkyl group, an alkenyl group, an alkinyl group, an aralkyl group, a cycloalkyl group, an aryl group, a halogen atom, a cyano group, a nitro group, a mercapto group, a hydroxy group, an alkoxy group, an arloxy group, an alkylthio group, an arylthio group, an acyloxy group, a sulfonyloxy group, an amino group, an ammonio group, a carbonamido group, a sulfonamido group, an oxycarbonylamino group, an oxysulfonylamino group, an ureido group, a thioureido group, an acyl group, an oxycarbonyl group, a carbamoyl group, a thiocarbonyl group, a thiocarbamoyl group, a sulfonyl group, a sulfinyl group, an oxysulfonyl group, a sulfamoyl group, a sulfino group, a sulfano group, a carboxyl or carboxylate group, a sulfonic acid or sulfonate group, or a phosphonic acid or phosphonate group, and $R_2$ and $R_3$ may be subjected to ring closure to form a saturated carbon ring, an aromatic hydrocarbon ring or a heterocyclic aromatic ring;

$$[MX_nL_{(6-n)}]^m \quad \text{(II)}$$

wherein M represents a metal ion, L represents a compound of the foregoing formula (III), X represents a halogen ion, n represents 3, 4 or 5, and m represents −5, −4, −3, −2, −1, 0, +1 or +2.

2. The silver halide photographic material as in claim 1, wherein said silver halide emulsion comprises silver halide grains containing the compound represented by formula (I) or (II).

3. The silver halide photographic material as in claim 1, wherein said M in formula (I) is at least one metal or metal ion selected from the group consisting of titanium, vanadium, chromium, manganese, iron, cobalt, nickel, copper, zirconium, rhodium, palladium, silver, iridium, platinum, gold, tin and the ions thereof.

4. The silver halide photographic material as in claim 1, wherein at least one of the chemical species represented by $L^I_{(4-x)}$ when x is 1, 2 or 3 in formula (I) is a halogen ion.

5. The silver halide photographic material as in claim 4, wherein said M in formula (I) is at least one metal ion selected from the group consisting of cobalt, nickel and copper ions.

6. The silver halide photographic material as in claim 5, wherein at least one of the groups $R_1$, $R_2$ and $R_3$ in formula (III) is a group selected from the group consisting of a methyl group, an ethyl group, a n-propyl group and an i-propyl group.

7. The silver halide photographic material as in claim 6, wherein the chemical species represented by $L^I$ in formula (I) is a chlorine ion.

8. The silver halide photographic material as in claim 1, wherein said M in formula (II) is a metal ion selected from the group consisting of ruthenium, titanium, manganese, platinum and tin ions.

9. The silver halide photographic material as in claim 8, wherein at least one of the groups $R_1$, $R_2$ and $R_3$ in the compound of formula (III) is a group selected from the group consisting of a methyl group, an ethyl group, a n-propyl group and an i-propyl group.

10. The silver halide photographic material as in claim 9, wherein the halogen ion represented by X in formula (II) is a chlorine ion.

* * * * *